US007439832B1

(12) United States Patent
Radosavljevic et al.

(10) Patent No.: US 7,439,832 B1
(45) Date of Patent: Oct. 21, 2008

(54) ELECTRICAL WIRING DEVICE SWITCH ASSEMBLY AND COMBINATION DEVICE WITH CIRCUIT PROTECTION COMPONENT

(75) Inventors: Dejan Radosavljevic, Syracuse, NY (US); Richard Weeks, Little York, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 252 days.

(21) Appl. No.: 10/994,662

(22) Filed: Nov. 22, 2004

Related U.S. Application Data

(60) Provisional application No. 60/553,795, filed on Mar. 16, 2004.

(51) Int. Cl.
*H01H 73/00* (2006.01)
*H01H 73/12* (2006.01)
*H01H 75/00* (2006.01)

(52) U.S. Cl. ..... 335/18; 335/8; 361/142; 361/143

(58) Field of Classification Search ..... 335/8–10, 335/18, 167–176; 361/142, 143
See application file for complete search history.

(56) References Cited

U.S. PATENT DOCUMENTS 4,595,894 A * 6/1986 Doyle et al. ..... 335/18
4,851,951 A * 7/1989 Foster, Jr. ..... 335/18
5,982,593 A * 11/1999 Kimblin et al. ..... 361/42
6,487,057 B1 * 11/2002 Natili ..... 335/18
6,538,862 B1 * 3/2003 Mason et al. ..... 361/42
6,724,591 B2 * 4/2004 Clarey et al. ..... 361/42
6,805,469 B1 10/2004 Barton
6,814,611 B1 * 11/2004 Torres ..... 439/535
6,920,025 B2 * 7/2005 Nelson ..... 361/42
6,989,489 B1 * 1/2006 Savicki, Jr. ..... 174/50
7,049,910 B2 * 5/2006 Campolo et al. ..... 335/18
7,118,235 B2 10/2006 Barton
2006/0195733 A1 * 8/2006 DeHaven ..... 714/724

* cited by examiner

*Primary Examiner*—Anh Mai
*Assistant Examiner*—Bernard Rojas
(74) *Attorney, Agent, or Firm*—William Greener; Bond, Schoeneck & King, PLLC

(57) ABSTRACT

An electrical wiring device including a plurality of independent switches and a circuit interrupter. In an aspect, two adjacent switches are provided. The user accessible portions of the switches operate in a direction parallel to the major longitudinal axis of the electrical wiring device. A protected receptacle may also be provided. The circuit protection component includes a line terminal connectable to a source of voltage, a load terminal connectable to a load, a circuit interrupter that is configured to connect or disconnect the line terminal from the load terminal, a fault detection circuit that is configured to detect at least one predetermined condition, and a trip mechanism in operable communication with the circuit interrupter to disconnect the line terminal from the load terminal upon detection of the predetermined condition. In an aspect, an electrical wiring device includes a common member having a plurality of fixed contacts and a common terminal configured to be user connectable to a hot line or a hot load source.

38 Claims, 19 Drawing Sheets

ELECTRICAL WIRING DEVICE SWITCH ASSEMBLY AND COMBINATION DEVICE WITH CIRCUIT PROTECTION COMPONENT

RELATED APPLICATION DATA

This application claims priority to U.S. Provisional Application Ser. No. 60/553,795 filed on Mar. 16, 2004.

FIELD OF THE INVENTION

Embodiments of the invention generally relate to the field of electrical wiring devices and, more particularly, to an electrical wiring device including a switch assembly and to an electrical wiring device including one or more of the switch assemblies in combination with a circuit protection component.

BACKGROUND OF THE INVENTION

The switch component of an electrical wiring device typically includes a user accessible switch arm, rocker paddle, push button, touch pad, etc. ("switching surface"), a lever arm or suitable linkage attached to the backside of the switching surface, and a line side contact that can be connected/disconnected from a load side contact via operation of the switching surface by the user. A common single switch device for activating a remote receptacle or light, for example, typically presents the switching surface in the center of the electrical wiring device having an on/off motion along the longitudinal axis of the device. When two switches are presented on a single electrical wiring device, or a switch and a receptacle, for example, are presented on a single device, the switching surface(s) operates in a direction that is transverse to the length of the device. Accordingly, switch placement, orientation, size and ergonomics become considerations in modern, functional and aesthetic switch design.

Safety is a further major consideration in the design and operation of electrical wiring devices. For example, a receptacle disposed in an electrical distribution system may supply power through a user attachable plug to a load or to other receptacles. In certain environments where a greater likelihood for an electrical shock hazard exists, such as in a residential bathroom or kitchen, for example, the receptacle may include a circuit protection component, e.g., a ground fault circuit interrupter (GFCI; however, the use of wiring devices having a circuit protection component or capability is in no way limited to this exemplary environment). GFCIs have been known for many years. Their intended purpose is to protect the electrical power user from electrocution when a hazardous ground fault condition is present. Ground fault conditions are an unintended current path from the line conductor having faulty or damaged insulation to ground. The shock hazard occurs when someone contacts ground and the line conductor at the same time. A fire hazard may occur if the ground fault current results in sufficient heating to ignite nearby combustibles. GFCIs configured to prevent fire but not necessarily protect a user from electrocution are known as ground fault equipment protectors (GFEPs.)

Other known protective devices include arc fault circuit interrupters (AFCIs). Their intended purpose is to protect the electrical power user from fire when a hazardous arcing condition is present. Hazardous arc fault conditions (known as series arc faults) may result from a poor electrical connection in the electrical distribution system supplying power to the load. Hazardous arcing conditions (known as parallel arc faults) may result from a line to line conductor, line to neutral conductor, or line to ground conductor, due to faulty or damaged insulation. The heat associated with the arc fault condition may be sufficient to ignite nearby combustibles.

Known protective devices such as GFCIs, GFEPs, AFCIs or combinations of such devices are configured to protect an electrical distribution system from at least one fault condition. Such devices are typically provided with line terminals for coupling to the supply voltage of the electrical distribution system, and load terminals coupled to the protected portion of the system and a circuit interrupter for disconnection of the load terminals from the line terminals. Load terminals may include plug receptacles for electrical connection of a user attachable load through a plug. Load terminals may include feed-through terminals for attachment to other receptacles. The protective device may be provided with a sensor for sensing the fault, a detector for establishing if the sensed signal represents a true hazardous fault, as opposed to electrical noise, and a switch responsive to the detector sensor, wherein the circuit interrupter comprising the contacts of a relay or trip mechanism are operated by a solenoid responsive to the switch to disconnect the load terminals from the line terminals. The disconnection is also known as tripping. A power supply may be required to furnish power to the sensor, detector, switch or solenoid.

Protective devices are commonly equipped with a test button which the owner of the protective device is instructed to operate periodically to determine the operating condition of the sensor, the detector, the switch, trip mechanism or relay, or power supply, any of which can fail and which may cause the circuit interrupter to not operate to remove power from the load side of the protective device to interrupt the fault. Since the protective device includes both electronic and mechanical components, failure modes may result from normal aging of electronic components, corrosion of mechanical parts, poor connections, mechanical wear, mechanical or overload abuse of the protective device in the field, electrical disturbances such as from lightning, or the like. Once the test has been manually initiated by operating the test button, the outcome of the test has often been indicated mechanically such as by a popping out of a button, visually through a lamp display or pivoting flag that comes into view, or audibly through an annunciator. As an alternative to a manual test, a self-test feature can be added to the protective device for automatic testing such as is described in U.S. Pat. No. 6,621,388 and U.S. application Ser. No. 09/827,007 filed Apr. 5, 2001 and entitled LOCKOUT MECHANISM FOR USE WITH GROUND AND ARC FAULT CIRCUIT INTERRUPTERS, both of which are incorporated herein by reference in its entirety. Once the test has been automatically initiated through the self-test feature, the outcome of the test can be indicated by any of the previously described methods or by the permanent disconnection of the load terminals from the line terminals of the protective device component, also known as "lock-out".

Further variations on circuit protection devices exist. For example, commonly assigned copending application Ser. No. 10/768,530, filed on Jan. 30, 2004, entitled CIRCUIT PROTECTION DEVICE WITH GROUNDED NEUTRAL HALF CYCLE SELF TEST teaches a circuit protection device that self checks for ground fault detection every half cycle.

Commonly assigned copending application Ser. No. 10/729,392, entitled PROTECTION DEVICE WITH LOCKOUT TEST teaches a device that protects from arc faults and ground faults, which is provided with a manual test feature that permanently denies power to the protected circuit should the test fail. Commonly assigned U.S. Pat. No. 6,522,510 and U.S. application Ser. No. 09/718,003 filed Nov. 21, 2000, entitled GROUND FAULT CIRCUIT INTERRUPTER WITH MISWIRE PROTECTION AND INDICATOR teaches a ground fault interrupter device with miswire protection and indicator functions. These three applications are hereby incorporated by reference in their entireties. Protection devices include a housing such as a receptacle housing. The housing is configured for installation into an outlet box. The outlet box is disposed in a ceiling, wall, floor, countertop, or the like. Alternatively, the housing is configured to be installed in a load device without necessarily using an outlet box. Receptacle devices have been known to include a protection device and a user accessible switch (hereinafter to be called a combination device.) The switch includes electrical contacts that are connected to a set of switch terminals. The switch terminals are connected or disconnected in response to a rocking motion of the switch. The switch terminals may be conductive portions at the ends of wires. The switch terminals and protective device terminals are connected to the electrical distribution system.

One disadvantage of known combination devices is that the user accessible switch toggles in a motion that is parallel to the minor (latitudinal) axis of the device. The user of the device does not find such rocking motion to be ergonomic. Another disadvantage is that such rocking motion is not consistent with other wiring devices whose rocking motion is perpendicular to the minor axis of the device. Another disadvantage of known combination devices is that the user accessible switch portion of the combination device has been limited in number to a single switch.

Accordingly, there is a need to provide a compact switch assembly for use in an electrical wiring device that is functional and ergonomic. There is also a recognized need for a combination device (i.e., circuit interrupter and one or more switch assemblies) that is ergonomic and convenient to use.

SUMMARY OF THE INVENTION

Embodiments of the invention are directed to an electrical wiring device including a switch assembly and to an electrical wiring device including one or more of the switch assemblies in combination with a circuit protection component.

An embodiment of the invention is directed to an electrical wiring device configured to be disposed in an electrical distribution system including a power source. The device includes a housing, a common member disposed in the housing having a plurality of fixed contacts and a common terminal that is configured to be user connectable to the power source, and a plurality of switch assemblies corresponding to the plurality of fixed contacts for controlling the flow of electrical power from the power source. Each of the switch assemblies includes a user accessible switch surface, a pivot assembly having a cradle and a load terminal configured to be user connectable to a load, and a pivot member rockably mounted in the cradle and in operative connection with the user accessible switch surface. The pivot member has a contact that is in alignment with a respective fixed contact of the common member, such that the common terminal and the load terminal are electrically connected when the pivot member is in an electrically closed position and wherein the common terminal and the load terminal are electrically disconnected when the pivot member is in an electrically open position via action of the user accessible switch surface. In an aspect, the switch is a single pole switch. In another aspect, the pivot member rocks in a direction that is parallel to a major longitudinal axis of the device. Thus the pivot member has an axis of rotation that is perpendicular to a major longitudinal axis of the device. In an aspect, the load terminal includes a feed-through terminal.

In a further aspect, the device includes two, independent switch assemblies that are disposed adjacently in the housing. According to an aspect, the two, independent switches are single pole switches. In an aspect, the axis of rotation of each pivot member of the two switch assemblies is a common axis of rotation for the two switches. The common axis is an axis of rotation that is perpendicular to a major longitudinal axis of the device; thus the two adjacent switches have respective accessible switch surfaces that rock or rotate in the direction of the major longitudinal axis of the device.

According to another embodiment, an electrical wiring device including at least two adjacent switch assemblies and a common member as described immediately above also includes a circuit interrupter that is configured to connect or disconnect the power source from the load terminal, and a trip mechanism that operates in connection with the circuit interrupter to disconnect the power source from the load terminal upon detection of a predetermined fault condition. In an aspect, the predetermined condition detectable by the circuit protection component includes either a test cycle, an electrical arc, a ground fault or a grounded neutral. In various aspects, the circuit protection device may be a GFCI or an AFCI. In another aspect, the load terminal includes a feed-through terminal. According to another aspect, the load terminal includes a plug receptacle terminal.

Another embodiment of the invention is directed to an electrical device configured to be disposed in an electrical distribution system including a power source. The device includes a common member disposed in a housing having a plurality of fixed contacts and a common terminal configured to be user connectable to the power source; a plurality of switches corresponding to the plurality of fixed contacts for controlling the flow of electrical power from the power source; a circuit interrupter that is configured to connect or disconnect the power source from a load terminal; and a trip mechanism in operable communication with the circuit interrupter to disconnect the power source from the load terminal upon detection of a predetermined condition. The nature of the switch assemblies and circuit interrupter are the same as in the embodiment described above.

In each of the embodiments referred to above, the power source may be a hot line or a hot load.

The foregoing and other objects, features, and advantages of embodiments of the present invention will be apparent from the following detailed description of the preferred embodiments, which makes reference to several drawing figures.

DETAILED DESCRIPTION OF A PREFERRED EMBODIMENT OF THE INVENTION

Figure 1A:
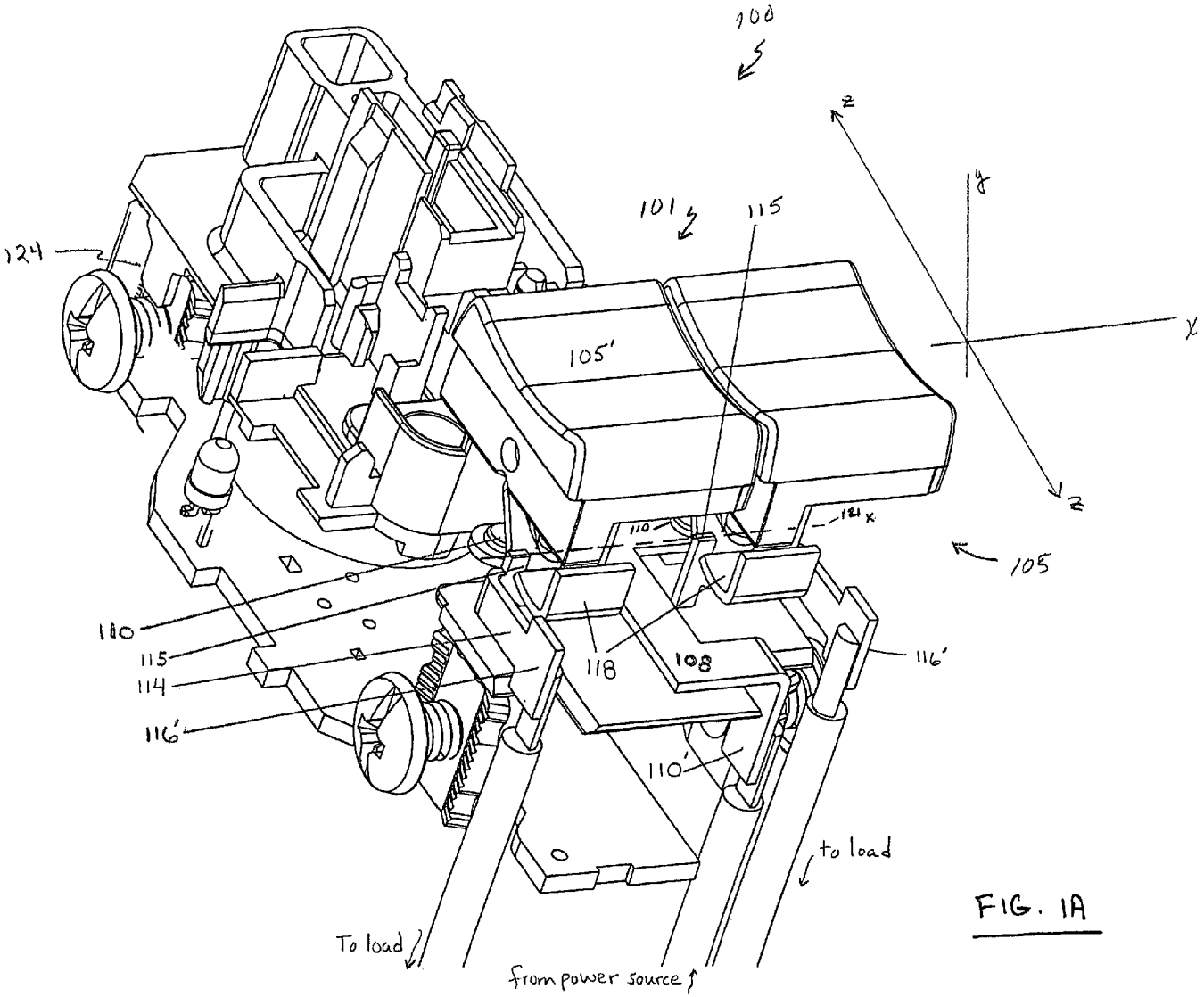
FIG. 1A is a perspective line drawing of an electrical device according to an embodiment of the invention.

An embodiment of the invention is directed to an electrical wiring device for use in an electrical distribution system that includes a power source. The device 100, illustrated in part in FIGS. 1A and 2, includes a switch assembly 101 that controls the flow of electricity from the power source, including from a hot load terminal or a hot line terminal, to a load terminal. Although a switch assembly 101 including two switches 105 is depicted in the figures, the principals of operation and the components of each switch apply to a single switch or to two or more switches. Disposed within the bottom portion 104*b* of device housing 104 as shown in FIG. 3 is a switch frame 107 for holding the switch components, hereinafter referred to collectively as switch 105. The switch 105 includes a user-accessible surface 105', a pivot assembly 114 having a cradle 115 and a load terminal 116' that is configured to be user-connectible to a load. The pivot assembly 114 further includes a pivot member 118 disposed in the cradle and operatively connected to the user accessible surface 105'. The pivot member 118 has an electrical contact 116 disposed therein. Another component of the switch assembly 101 includes a common member 108 that is disposed in the switch frame 107. The common member has a fixed electrical contact 110 disposed thereon and a common terminal 110', which can be connected to the power source by a user. The fixed contact 110 of the common member 108 and the pivot member contact 116 are in alignment such that when the switch is in an electrically closed position, the common terminal 110' and the load terminal 116' are electrically connected. Likewise, the common terminal and the load terminal are electrically disconnected when the pivot member is in an electrically open position with respect to the common fixed contact via action of the user-accessible surface.

Figure 1B:
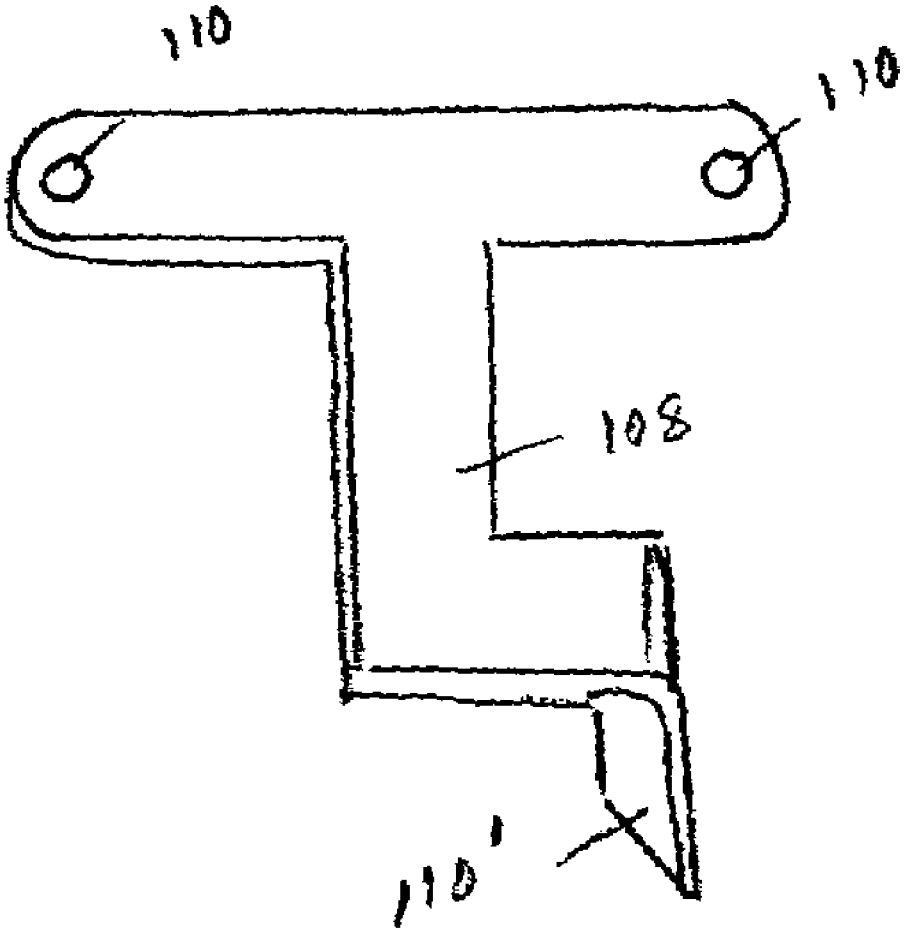
FIG. 1B is a line drawing of a component of the device shown in FIG. 1A.
Figure 2:
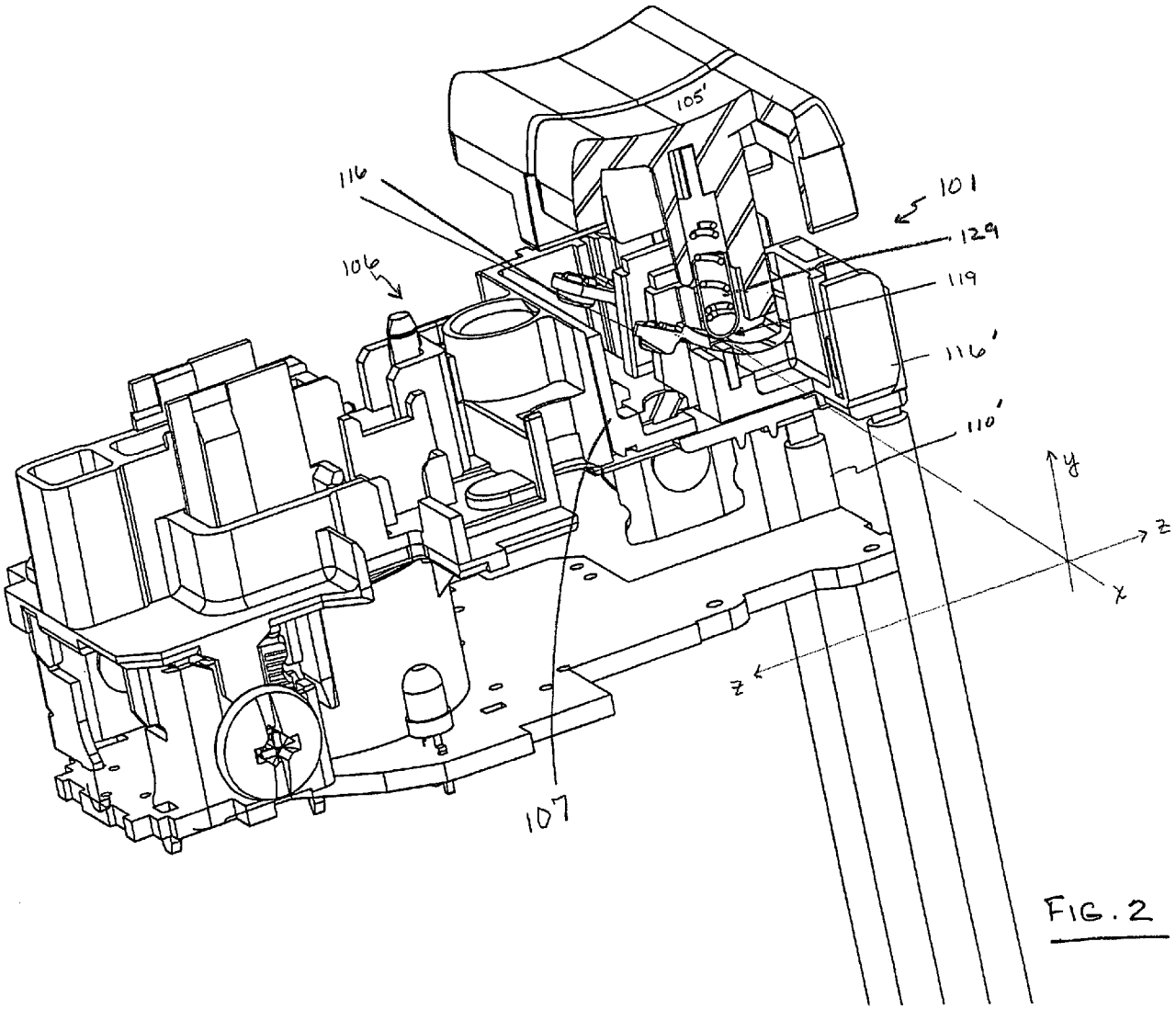
FIG. 2 is a perspective line drawing of the electrical device illustrated in FIG. 1 from another perspective.
Figure 3:
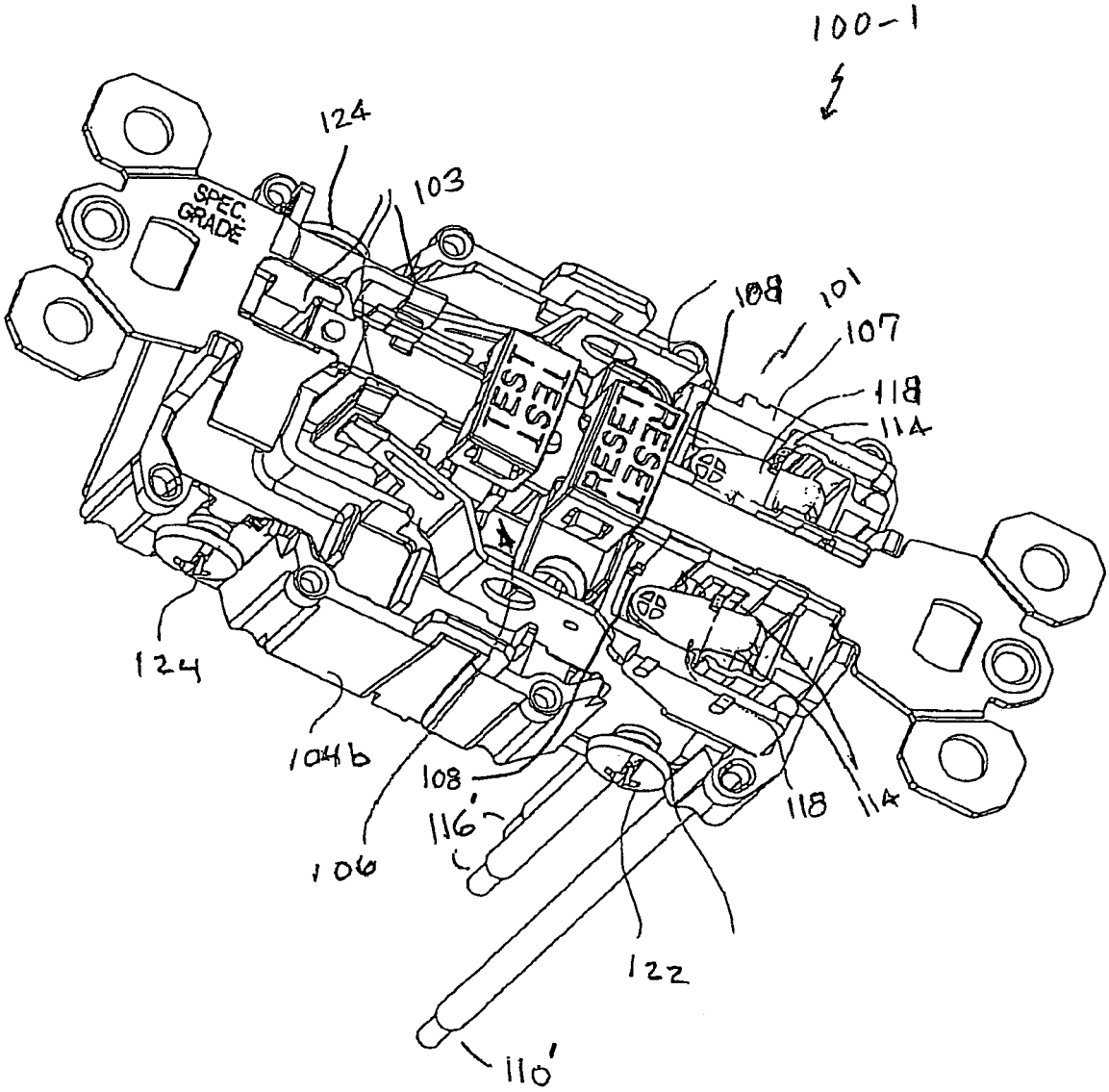
FIG. 3 is a perspective line drawing of the interior of the electrical device illustrated in FIGS. 1 and 2.

As shown in FIGS. 1 and 2, the user-accessible surface has a concave profile for activating a rocker-style switch. The user surface 105' rocks in a motion that is parallel to a major longitudinal axis of the electrical wiring device as represented by the z-axis of the coordinate system shown in FIG. 1. The surface component 105' thus pivots on an axis of rotation that is perpendicular to the major longitudinal axis of the device as represented by the x-axis of the coordinate system shown in FIG. 1. It will be appreciated by those skilled in the art that the user-accessible surface is not limited to a concave profile, rather, it could be a flat or contoured surface appropriate to the operation and style of the switch. Likewise, the switch is not limited to a rocker style switch, but may be a toggle style, push-button, pressure-sensitive or other style switch known in the art.

In the rocker style switch aspect as shown, a spring loaded pin 129 as shown in FIG. 2 extends from the backside of user surface 105'. The free end of the pin is in contact with a surface of the pivot member 118 in a region 119 where the pivot member rests in cradle 115. Since point 119 is a pivot point for the pivot member in the cradle, movement of the switch surface 105' sweeps the spring loaded pin 129 through a radius exerting force on the pivot member at one or the other side of the pivot point. As described above, since the fixed contact 110 of the common member 108 and the contact 116 on the swinging end of the pivot member are cooperatively aligned, a downward force on the pivot member forward of the pivot point causes the contacts to touch. The pivot assembly 114 also has a portion 116' at an end thereof that is connectable to a load or otherwise in the electrical distribution system by the installer. As can be seen in the figure, the pivot member 118 rocks in the pivot cradle 115 in the same direction as that of the switch surface 105'. As shown, the pivot member rocks along a pivot axis $\mathbf{121}_x$.

An isolated view of the common member 108 is shown in FIG. 1B. A substantially two-dimensional portion of the pivot member 108 has a general T-shape. Two contacts 110 are shown at respective end regions of the T-portion. In the aspect of the device shown in FIGS. 1 and 2, two single pole switches are disposed side by side in the device. Each switch 105 is independent of the other and includes its respective pivot assembly including pivot member 118 and load terminal 116'. The common member 108, however, is referred to as such because it contains respective fixed contacts 110 for each independent switch. A portion of the common member extending from the base of the T-portion is the common terminal 110', which can be connected to a power source in the electrical distribution system by the installer. Thus, while the common member is always electrically hot, each load terminal 116' has power only when the respective pivot member contact 116 closes the circuit with a corresponding common contact 110.

Terminals 110' and 116' may include wire portions that may be selectively colored for identification purposes. Alternatively, labels may be included in the housing 104 of the electrical wiring device for terminal identification.

As described above, each switch has a respective user-accessible surface 105', and pivot assembly 114 including load terminal 116' and pivot member 118 having an electrical contact 116. If two or more switches are immediately adjacent, each pivot member will rotate about a common pivot access $\mathbf{121}_x$. As stated previously, the switch design is advantageous as it allows ergonomic orientation of the switch operation, compact size, functional placement and desirable arrangement within the device housing, and other benefits. A particular advantage is that that aforementioned switch assembly provides enough space and functionality in a standard size electrical wiring device for other components to be used in combination therewith.

Another embodiment of the invention is directed to a combination electrical wiring device that includes a plurality of switch assemblies as described above in combination with a circuit protection component hereinafter referred to as a circuit interrupter. The circuit interrupter is configured to connect or disconnect the power source from the load terminal, and a trip mechanism in cooperative operation with the circuit interrupter is provided to disconnect the power source from the load terminal upon detection of a predetermined condition.

An exemplary combination device 100-1 is illustrated with reference to FIG. 3. In addition to the switch assembly 101, a circuit interrupter 106 is disposed in the bottom housing portion 104*b* of the device.

Figure 4:
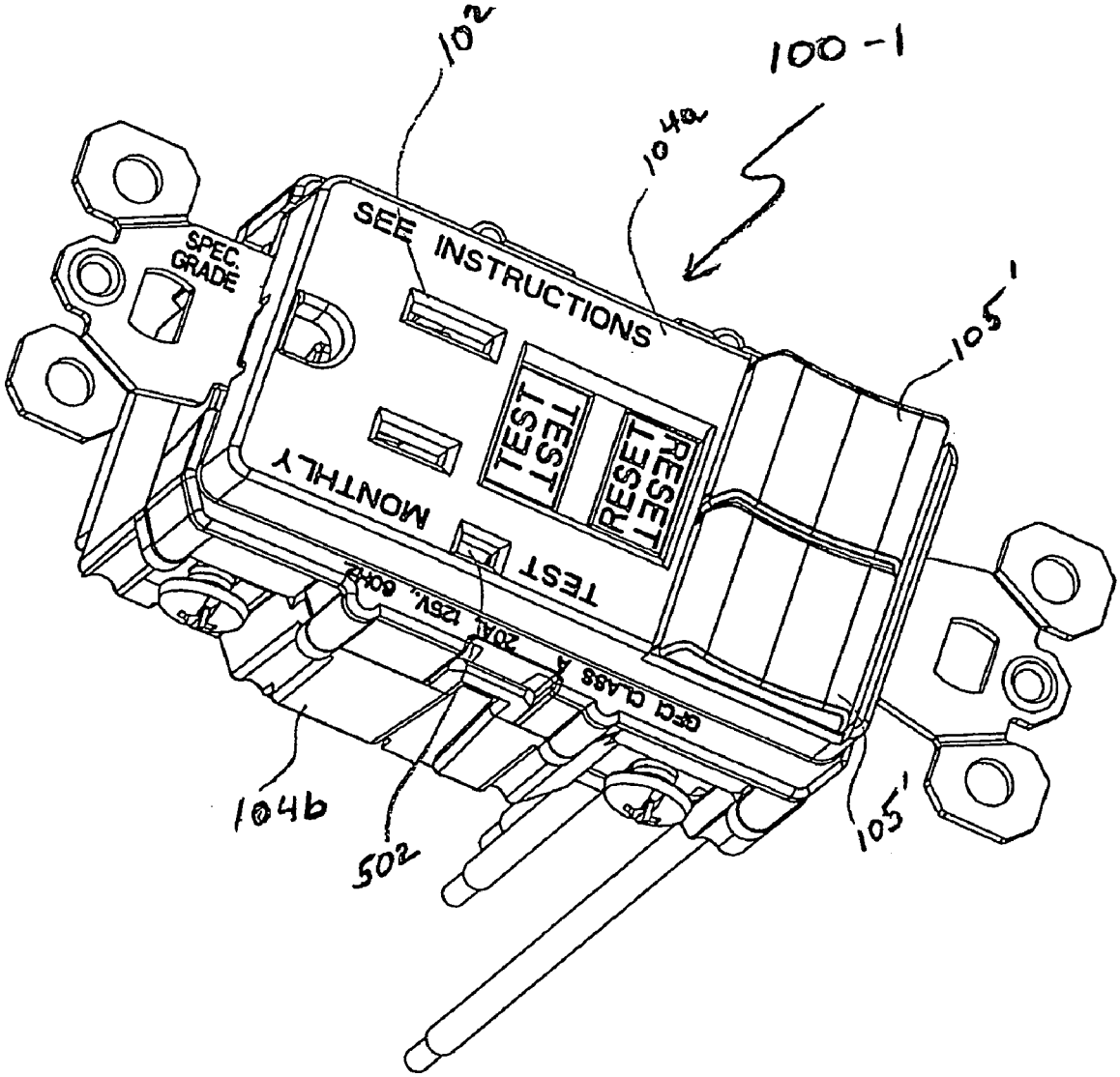
FIG. 4 is a perspective line drawing of the exterior of the electrical device illustrated in FIGS. 1, 2 and 3.

The circuit interrupter 106 includes line terminals 122 configured to be connected to the power source of the electrical distribution system and load terminals configured to connect to a protected portion of the electrical distribution system. The load terminals include receptacle contacts 103, or feed-through terminals 124, or both. Receptacle contacts 103 are disposed to align with receptacle openings 102 as shown in the device 100-1 as illustrated in FIG. 4. The blades of a user attachable plug (not shown) can pass through openings 102 to electrically mate with receptacle contacts 103. The housing 104 maintains the line terminals 122, the ground terminal (not shown) and the load terminals 124 of the circuit interrupter 106 in a spaced apart relationship to one another.

Figure 5A:
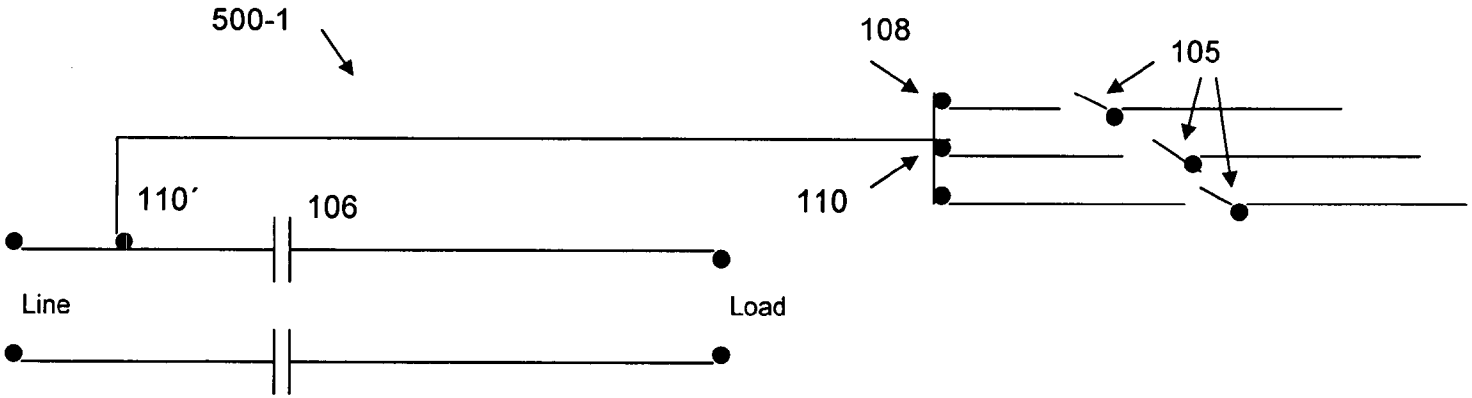
FIGS. 5A and 5B are circuit schematic line drawings of an electrical wiring device showing a common member connected to a hot line and to a hot load, respectively, according to aspects of an embodiment of the invention.
Figure 5B:
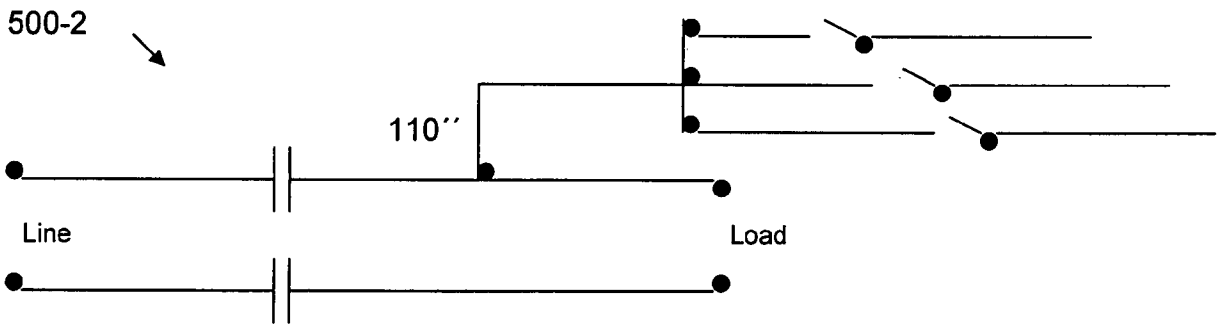

FIGS. 5A and 5B, respectively, illustrate simplified electrical circuit aspects 500-1, 500-2 according to electrical device embodiments of the invention. In FIG. 5A, an electrical device 500-1 includes a common member 108 having three fixed contacts shown at 110 and a common terminal 110' connected to a hot line source. Three single pole switches 105 corresponding to the plurality of fixed contacts 110 independently control the flow of electrical power from the hot line to a load. A circuit interrupter 106 provides for the electrical device 500-1 to be a combination device. The device 500-2 illustrated in FIG. 5B is similar to device 500-1 except that the common terminal 110' is connected to a hot load source 110". The common member 108, switches 105 and circuit interrupter 106 are similar to those described in greater detail herein.

Figure 6A:
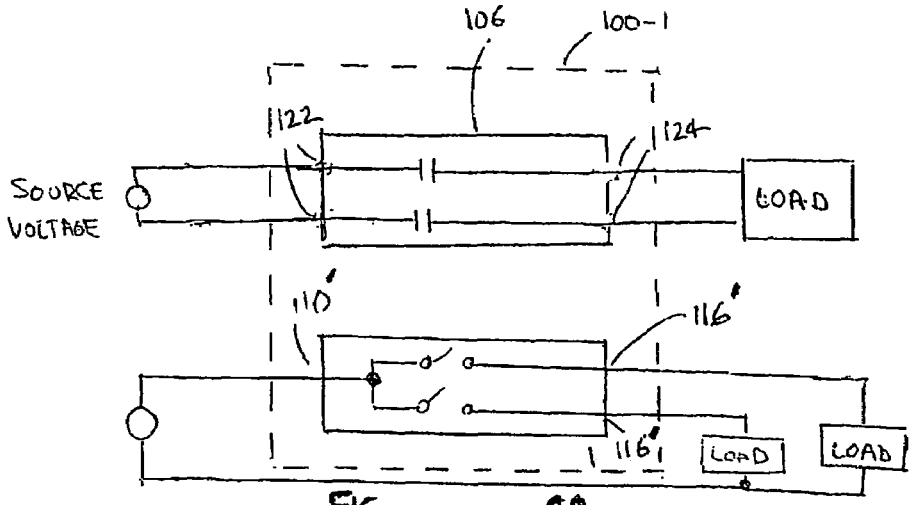
FIGS. 6A, 6B and 6C are schematic line drawings of circuits according to various aspects of an embodiment of the invention.
Figure 6B:
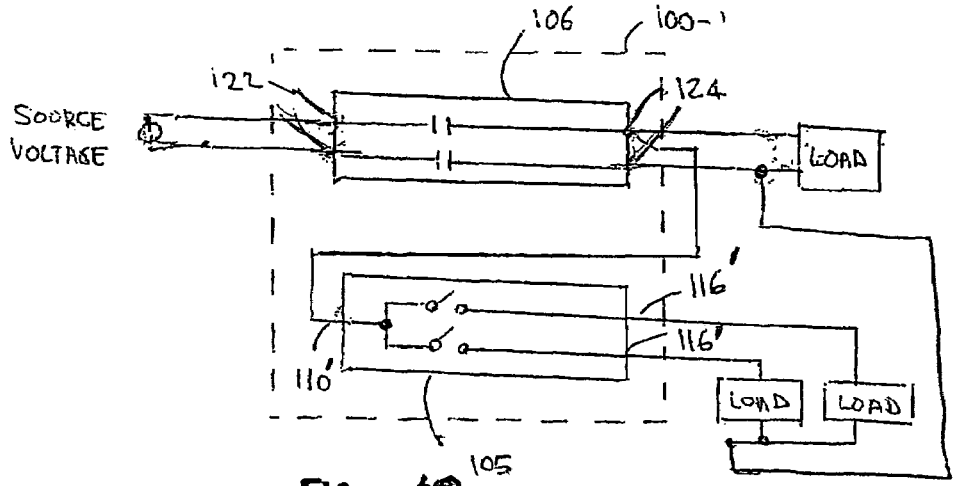
Figure 6C:
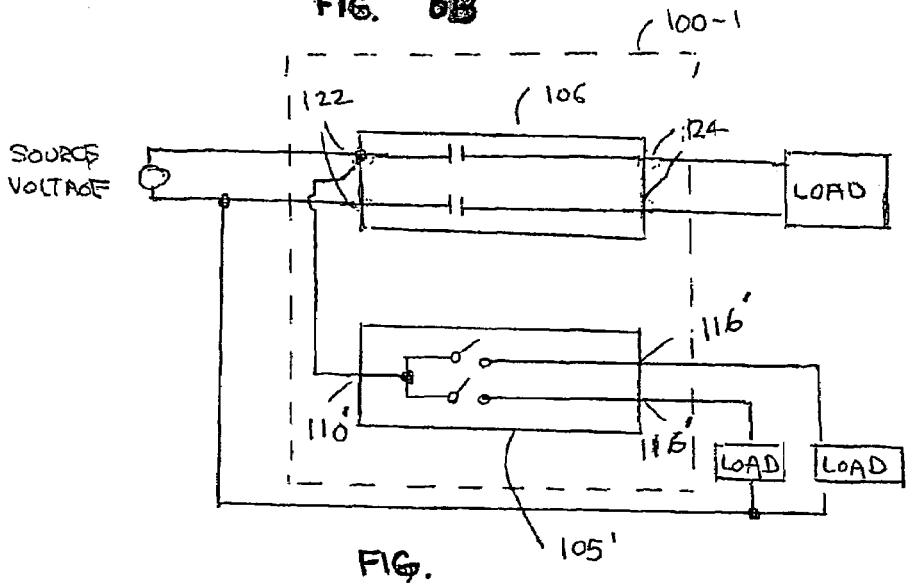

FIGS. 6A, 6B and 6C illustrate various ways in which terminals 110', 116' 122, 124 can be interconnected and connected to the electrical distribution system. Line terminals 122 are connected to the power source of the electrical distribution system. Load terminals including the plug receptacle terminals 103, feed-through terminals 124, or both, provide power to a protected portion of the electrical distribution system.

In FIG. 6A, the user accessible switch 105 is configured to provide switched power from an auxiliary power source to one or more loads. The auxiliary power source may have a phase or voltage that differs from the power source. The auxiliary power source may be configured to operate in electrical isolation with respect to the power source. As such, terminal 110' is not connected to terminals 122, 124. Feed-through terminals are configured for connection of a switch terminal.

As shown in FIG. 6B, the user accessible switch 105 is configured to provide protected power supplied by the circuit interrupter 106 to one or more loads. Terminal 110' is connected to a feed-through terminal 124. Terminal 116' of switch 105 provides power to one or more loads. Switch 105 is protected by the circuit interrupter 106. Thus if the circuit interrupter 106 senses a fault condition, no power is supplied by switch 105 regardless of whether the switch is open or closed.

Referring to FIG. 6C, the user accessible switch 105 is configured to provide unprotected power directly from the power source to one or more loads. Terminal 110' is connected to a line terminal 122. The remaining terminals 116' of switch 105 provide power to one or more loads. Line terminals 122 are configured for connection of a switch terminal.

In an aspect, the electrical wiring device may further include a trip indicator 502 mounted in and visible through the housing 104*a*, as illustrated in FIG. 4, for indicating the status of the circuit interrupter 106. The trip indicator 502, described in greater detail below, may include a visible indicator such as an LED, neon, or other suitable light source that illuminates when circuit interrupter 106 trips. A person skilled in the art will appreciate that indicator 502 may be configured to transmit continuous illumination or intermittent (blinking) illumination when the protection device is tripped. Alternatively, the trip indicator may include an annunciator. The annunciator may be configured to produce a steady sound or a beeping sound when component 106 is tripped. Alternatively, the trip indicator may include both an annunciator and a visual indicator.

Additional aspects of the invention will now be set forth along with exemplary circuit protection components 106-*n* and associated circuits. It is to be appreciated that the design per se of the circuit protection component is not meant to limit the embodied invention in any way. Thus various circuit protection components in the form of ground fault circuit interrupters (GFCIs) and arc fault circuit interrupters (AFCIs), for example, as known in the art, as may be disclosed herein, or as described in commonly assigned copending applications incorporated herein by reference.

Circuit Protection Device

An electrical distribution system typically includes a circuit breaker, branch circuit conductors, wiring devices, cord sets or extension cords, and electrical conductors within an appliance. A protective device typically is incorporated in an electrical distribution system for protecting a portion of the system from electrical faults. GFCIs are one type of protective device that provide a very useful function of disconnecting an electrical power source from the protected portion of the system when a ground fault is detected. Among the more common types of ground faults sensed by known GFCIs are those caused when a person accidentally makes contact with a hot electrical lead and ground. In the absence of a GFCI, life-threatening amounts of current could flow through the body of the person.

AFCIs are another type of protective device. AFCIs disconnect an electrical power source from a load when an arc fault is detected. Among the more common type of arc faults sensed by known AFCIs are those caused by damaged insulation such as from an overdriven staple. This type of arc fault occurs across two conductors in the electrical distribution system such as between the line and neutral conductors or line and ground conductors. The current through this type of fault is not limited by the impedance of the appliance, otherwise known as a load coupled to the electrical distribution system, but rather by the available current from the source voltage established by the impedance of the conductors and terminals between the source of line voltage and the position of the fault, thus effectively across the line, and has been known as a "parallel arc fault". Another type of arc fault sensed by known AFCIs are those caused by a break in the line or neutral conductors of the electrical distribution system, or at a loose terminal at a wiring device within the system. The current through this type of fault is limited by the impedance of the load. Since the fault is in series with the load, this type of fault has also been known as a "series arc fault". In the absence of an AFCI, the sputtering currents associated with an arc fault, whether of the parallel, series, or some other type, could heat nearby combustibles and result in fire or other damage.

Protective devices are typically provided with line terminals for coupling to the supply voltage of the electrical distribution system, load terminals coupled to the protected portion of the system, and a circuit interrupter for disconnection of the load terminals from the line terminals. The protective device is provided with a sensor for sensing the fault, a detector for establishing if the sensed signal represents a true hazardous fault, as opposed to electrical noise, and a switch responsive to the detector sensor, wherein the circuit interrupter comprising the contacts of a relay or trip mechanism are operated by a solenoid responsive to the switch to disconnect the load terminals from the line terminals. The disconnection is also known as "tripping". A power supply may be required to deliver power to the sensor, detector, switch or solenoid.

In one prior art approach, a protective device is equipped with a test button, which the owner of the protective device is instructed to operate periodically to determine the operating condition of the sensor, the detector, the switch, trip mechanism or relay, or power supply. Any of these components may fail and cause the circuit interrupter to fail to remove power from the load side of the protective device to interrupt the fault. Since the protective device comprises electronic and mechanical components, failure may occur because of normal aging of the electronic components, corrosion of the mechanical parts, poor connections, mechanical wear, mechanical or overload abuse of the protective device in the field, electrical disturbances (e.g., lightning), or for other reasons. Once the test has been manually initiated by operating the test button, the outcome of the test may be indicated mechanically by a button, or visually through a lamp display or pivoting flag that comes into view, or audibly through an annunciator.

In another prior art approach, a self-test feature can be added to the protective device for automatic testing as an alternative to a manual test. Once the test has been automatically initiated through the self-test feature, the outcome of the test can be indicated by any of the previously described methods or by the permanent disconnection of the load terminals from the line terminals of the protective device, also known as "lock-out."

Figure 7:
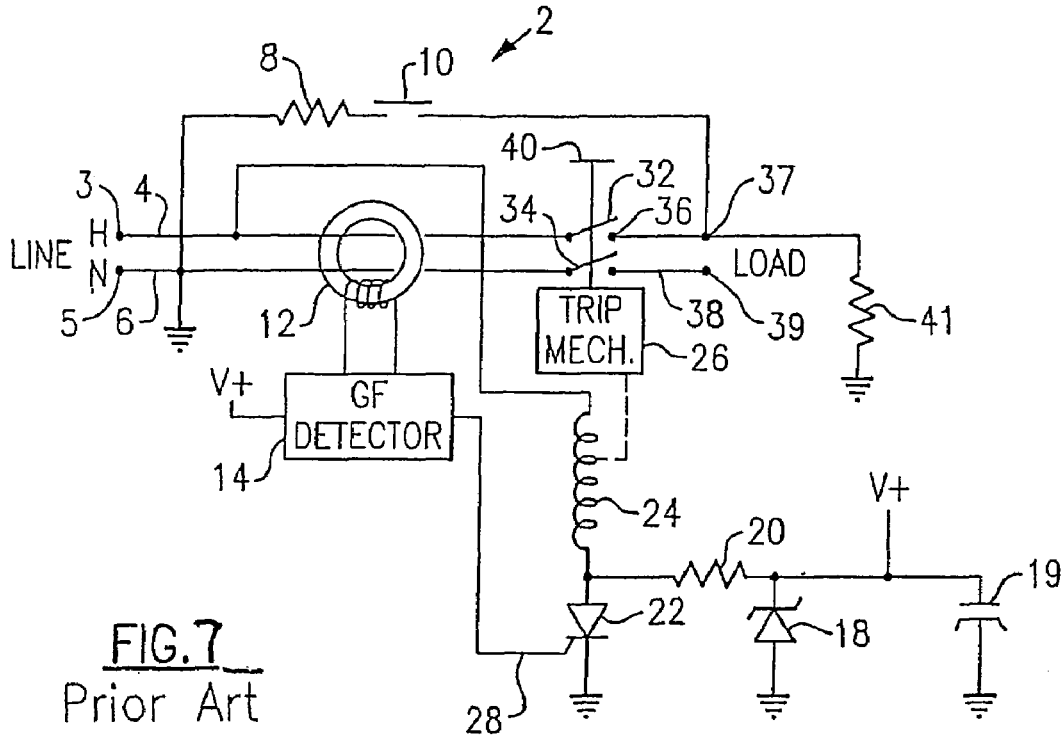
FIG. 7 Prior Art
FIG. 7 is an illustrative circuit diagram for a ground fault circuit interrupter (GFCI) according to the prior art.

Another approach that has been considered is depicted in FIG. 7. GFCI 2 includes line terminals 3 and 5 for coupling to a power source of the electrical distribution system and load terminals 37 and 39 appropriate to the installed location, whether a circuit breaker, receptacle, plug, module, or the like. A ground fault represented by resistor 41 produces an additional current in conductor 4 that is not present in conductor 6. Sensor 12 senses the difference current between conductors 4 and 6, which is then detected by a ground fault detector 14. Detector 14 issues a trip command to a Silicon Controlled Rectifier (SCR) 22 that in turn activates a solenoid 24, which activates a trip mechanism 26 releasing contact armatures 34 and 32, thereby disconnecting power to the load by breaking the circuit from a line hot 4 to a load hot 36 and from a line neutral 6 to a load neutral 38. A contact 10 ("TEST" button in FIG. 6) along with a resistor 8 form a test circuit that introduces a simulated ground fault. When contact 10 is depressed, the additional current on conductor 4 is sensed by sensor 12 as a difference current causing the device to trip. Current flows through resistor 8 for the interval between depression of the contact 10 and the release of contact armatures 34 and 32, which is nominally 25 milliseconds. The device is reset by pressing a reset button 40 ("RESET" button in FIG. 6), which mechanically resets trip mechanism 26. A resistor 20, a Zener 18, and a capacitor 19 from a power supply for GFCI 2.

Figure 8:
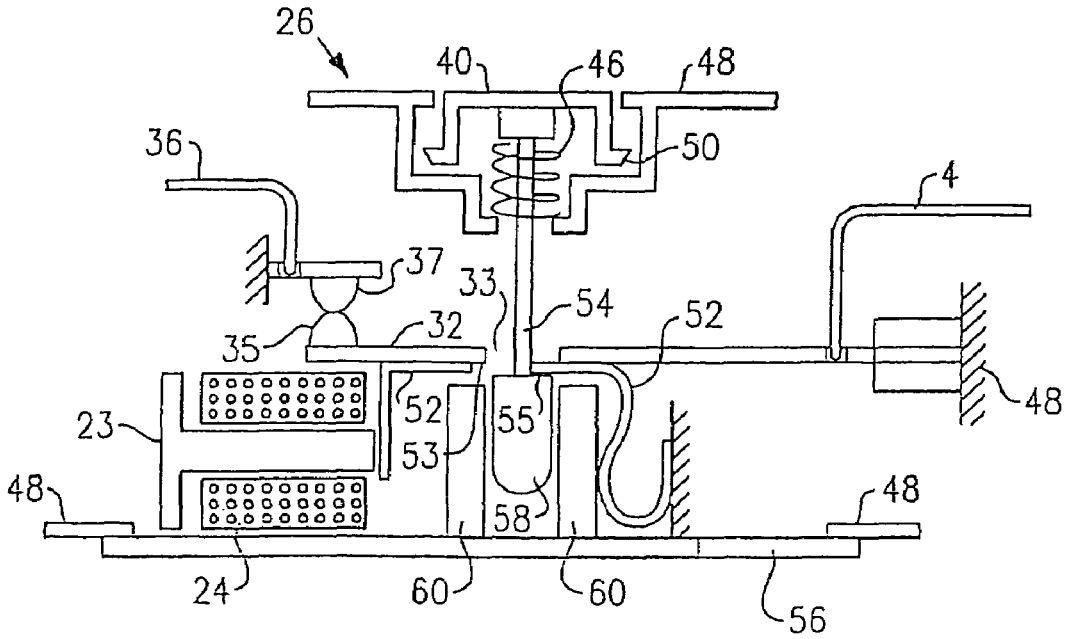
FIG. 8 Prior Art
FIG. 8 is a diagram of a partial sectional view of the mechanical implementation of the device illustrated in FIG. 7.

Referring to FIG. 8, the mechanical layout for the circuit diagram of FIG. 7 is shown. Trip mechanism 26 is shown in the set state, meaning that contacts 37 and 35 are closed. Contacts 35 and 37 are held closed by action of a trapped make-force spring 46 acting on an escapement 55 on a rest stem 54 to lift a reset latch spring 52 and by interference, an armature 32. Reset latch spring 52 includes a hole 53 and armature 32 includes a hole 33, which holes 33 and 53 permit entry of a tip 58 of reset stem 54. Reset stem 54 is held in place by a block 60. Armature 32 and a printed circuit board (PCB) 56 are mechanically referenced to a housing 48 so that the force in spring 46 is concentrated into armature 32.

Figure 9:
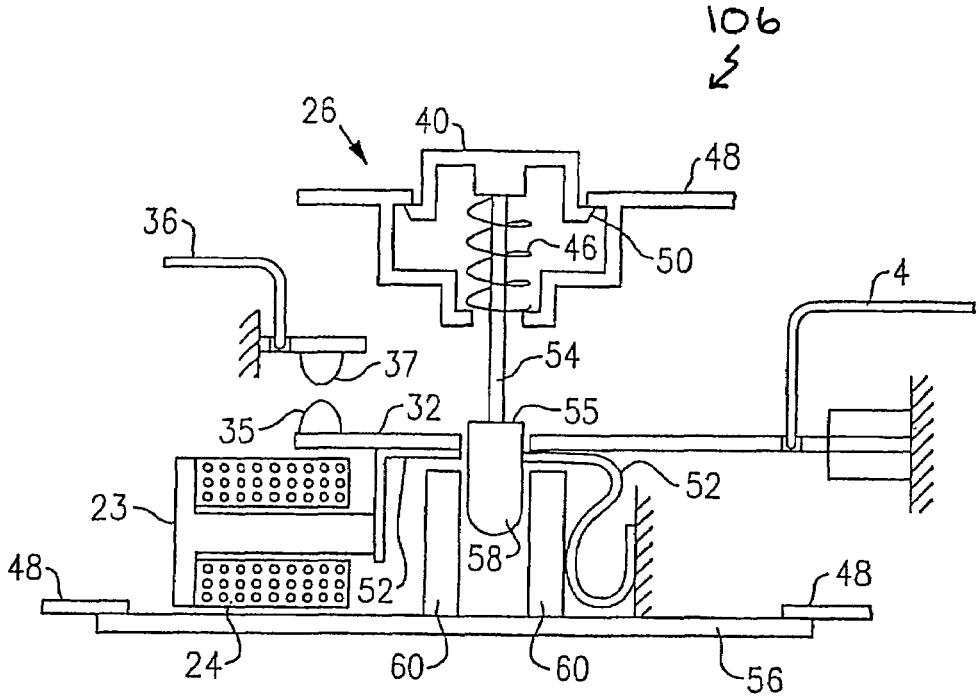
FIG. 9 Prior Art
FIG. 9 is a diagram similar to that of FIG. 8 showing the prior art device in a tripped state.

Referring to FIG. 9, the mechanism of FIG. 8 is shown in the tripped state. The tripped state occurs when SCR 22 activates a magnetic field in solenoid 24, which in turn pulls in plunger 23 to displace reset latch spring 52. Displacing reset latch spring 52 allows a flat portion 55 to clear the latch spring 53 interference, which then releases the interference between latch spring 52 and armature 32. Armature 32 has a memory that resets armature 32 to a resting position against solenoid 24, opening contacts 35 and 37 and disconnecting power to the load.

Figure 10:
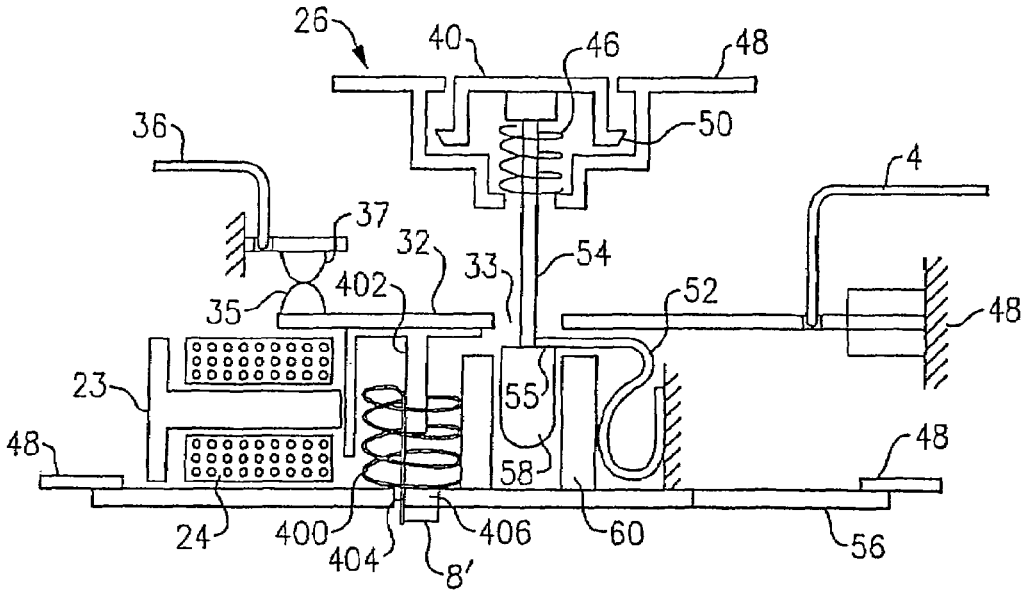
FIG. 10 is a diagram of a partial sectional view of a mechanical implementation of an exemplary circuit protection component of a device according to an embodiment of the invention.

Referring to FIG. 10, a partial sectional view of a mechanical implementation of an embodiment of the invention is shown. A resistor 8', shown schematically in FIG. 7 as resistor 8, is designed to withstand self-heating that results from each depression of contact 10 (FIG. 7), which causes current to flow through resistor 8' for the expected trip time of the GFCI. For example, resistor 8' for a 6 mA GFCI coupled to a 120V AC supply is required by UL to be 15 KOhms, which dissipates nominally 0.96 W during each trip time interval. In particular, resistor 8' must survive several thousand trip time intervals accomplished by alternately depressing contact 10 and reset button 40. During normal operation of GFCI 2, resistor 8' is physically positioned to restrain lockout spring 400. Resistor 8' is preferably mounted and soldered so that the body of resistor 8' impedes movement of lockout spring 400.

Figure 11:
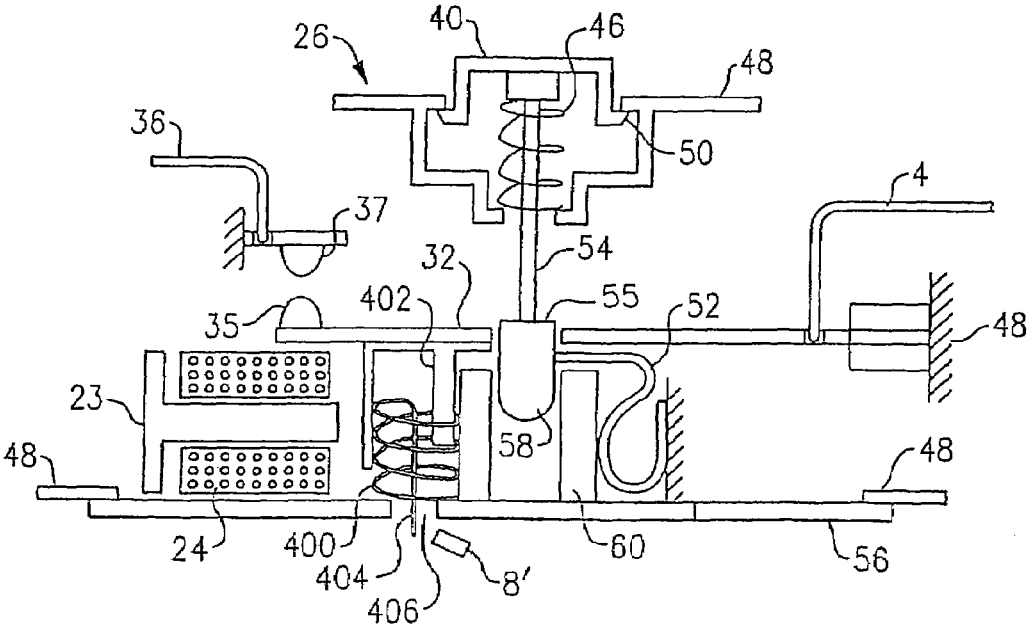
FIG. 11 is a diagram similar to FIG. 10 showing the component in a lock-out position.

Referring to FIG. 11, a partial sectional view of the mechanical implementation of FIG. 10 is shown in the lock-out position. The GFCI 2 has failed in some manner such that the trip time in response to depressing contact 10 is greater than the expected interval including failure of GFCI 2 to trip altogether. Examples of failure modes include a defective sensor 12, and for a sensor 12 comprising a transformer, open or shorted turns. The detector 14, typically composed of electronic components, may have poor solder connections or components that have reached end of life. The SCR 22 may short circuit either due to reaching end of life or due to a voltage surge, thereby causing continuous current through solenoid 24 which burns open through over activation or, alternatively, SCR 22 may be an open circuit. The mechanical components associated with trip mechanism 26 may become immobilized from wear or corrosion. The power supply, if provided, may fail to deliver power in accordance with the design such that sensor 12, detector 14, SCR 22, or solenoid 24 are non-operative. When failure of GFCI 2 occurs, the current through resistor 8' flows for the time that contact 10 is manually depressed, on the order of at least seconds, which is two orders of magnitude longer than if the trip mechanism 26 were to operate in response to depressing contact 10. Resistor 8', which is preferably coupled electrically to GFCI 2 through solder, heats from the current and melts the solder. Resistor 8', no longer restrained by the solder, or in an alternative embodiment by an adhesive, is physically dislodged by the bias of lockout spring 400. Force is then applied by an end 404 of lock-out spring 400 against a feature on the reset latch spring 52, for example, a tab 402. The force in lockout spring 400 is greater than the force in reset latch spring 52. As previously described, reset latch spring 52 is displaced allowing a flat portion 55 to clear the latch spring 53 interference, which then releases the interference between reset latch spring 52 and armature 32. Armature 32 has a memory that returns armature 32 to a resting position against solenoid 24, opening contacts 35 and 37 and disconnecting power to the load. Thus when the GFCI 2 is operational, the tripping mechanism 26 is able to operate, and the armatures 32 and 34 disconnect when plunger 23 applies force to reset latch spring 52. If GFCI 2 is not operative, lockout spring 400 applies force to reset latch spring 52, likewise causing armatures 32 and 34 to disconnect. When GFCI 2 is tripped under the influence of lockout spring 400, armatures 32 and 34 are permanently disconnected irrespective of depressing contact 10 or reset button 40 or any further movement in plunger 23.

Figure 12:
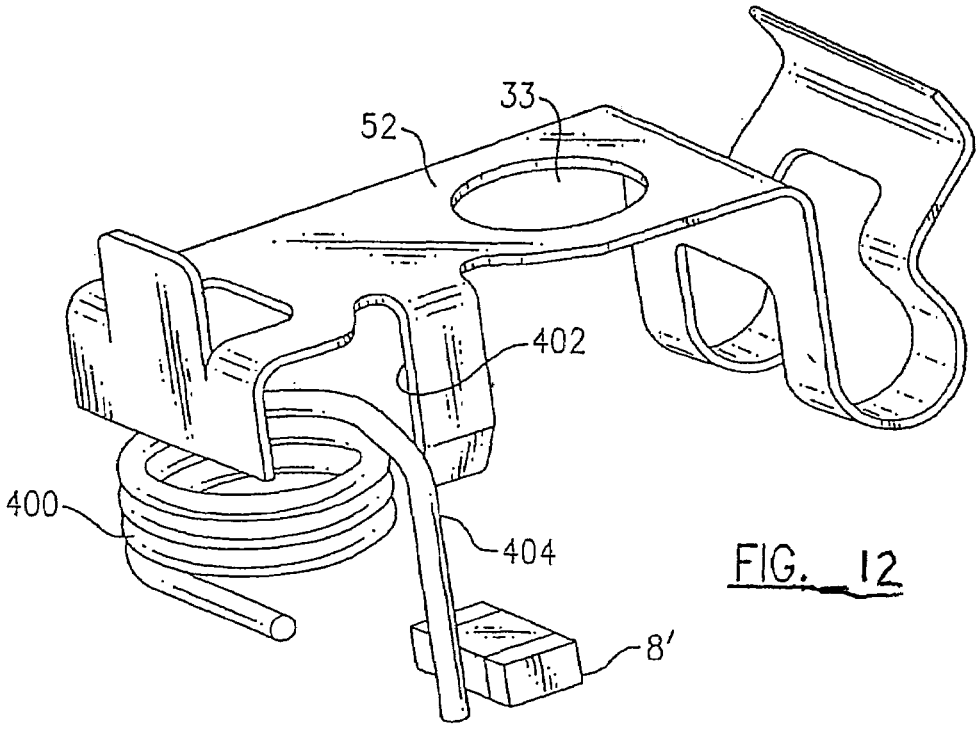
FIG. 12 is a perspective view of some of the components of the exemplary protective device of FIG. 10.

Referring to FIG. 12, components of the embodiment of FIG. 10 are shown in a three-dimensional view including lockout spring 400, end 404, resistor 8', and latch spring 52. Spring 404 is preferably affixed to the same structure as resistor 8'.

Figure 13:
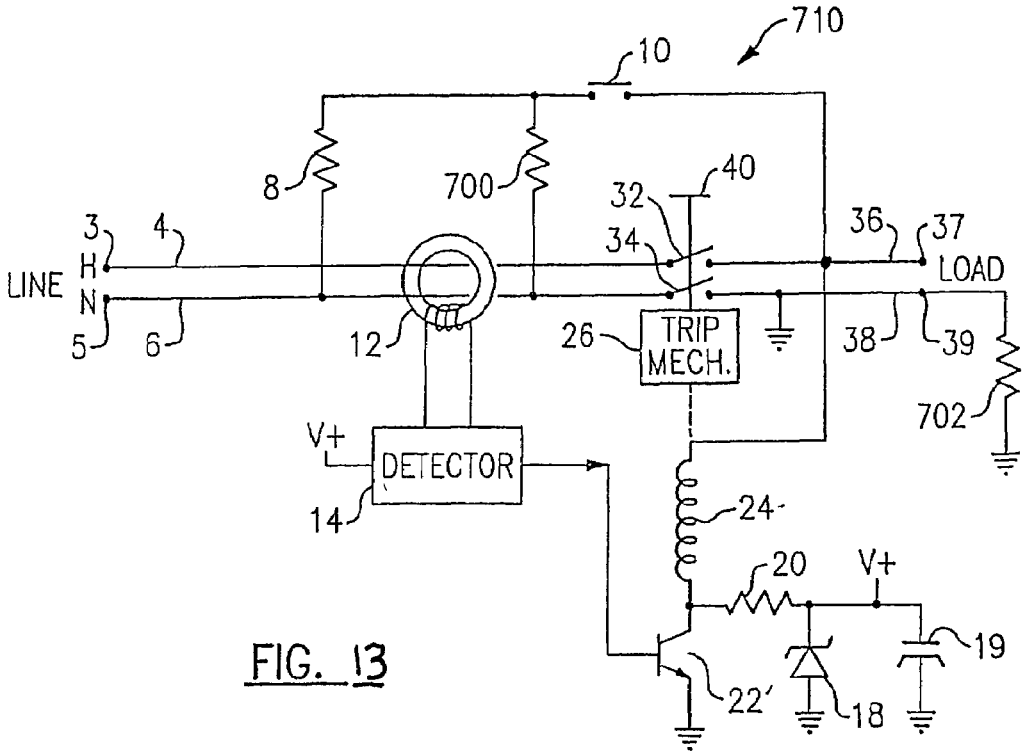
FIG. 13 is a schematic circuit diagram of an exemplary protective device according to an embodiment of the invention.

Referring to FIG. 13, a protective device 710 shows a resistor 700, which is then used as the resistor body that constrains spring 400. There are other ground fault circuit interrupters whose trip thresholds are greater than 6 mA, intended for a variety of supply voltages or phase configurations, and intended for personal protection or fire prevention. Alternative trip levels typically include 30 mA in the U.S. or Europe, or 300 or 500 mA in Europe. For devices where the current through resistor 8 may produce insufficient heat during the anticipated duration that contact 10 is manually depressed to melt the solder, resistor 8 can be supplemented by a resistor 700 in parallel with resistor 8, which connects to line 6 on the other side of sensor 12 from where resistor 8 connects to line 6. Currents through resistors 8 and 700 are enabled by depressing contact 10. Resistor 8 generates a simulated test signal comprising a difference current to test GFCI 2 as previously described. Resistor 700 is coupled so as to conduct common mode current but no difference current. Since the current through resistor 700 does not influence the amount of simulated test current required by UL, which is set by the value of resistor 8, the value of resistor 700 can be whatever value is convenient for producing sufficient heat in resistor 700 when contact 10 is manually depressed to release lockout spring 400 when GFCI 2 is not operational. FIG. 13 also shows how the lockout function is unaffected by whether the power supply for the GFCI comprising resistor 20, Zener 18, and capacitor 19 are coupled to the load side of armatures 32 and 34. Load side power derivation may be convenient for GFCIs or protective devices housed in a circuit breaker. FIG. 13 also shows how SCR 22 can be replaced by a transistor 22', with either device comprising a switch for controlling solenoid 24.

Figure 14:
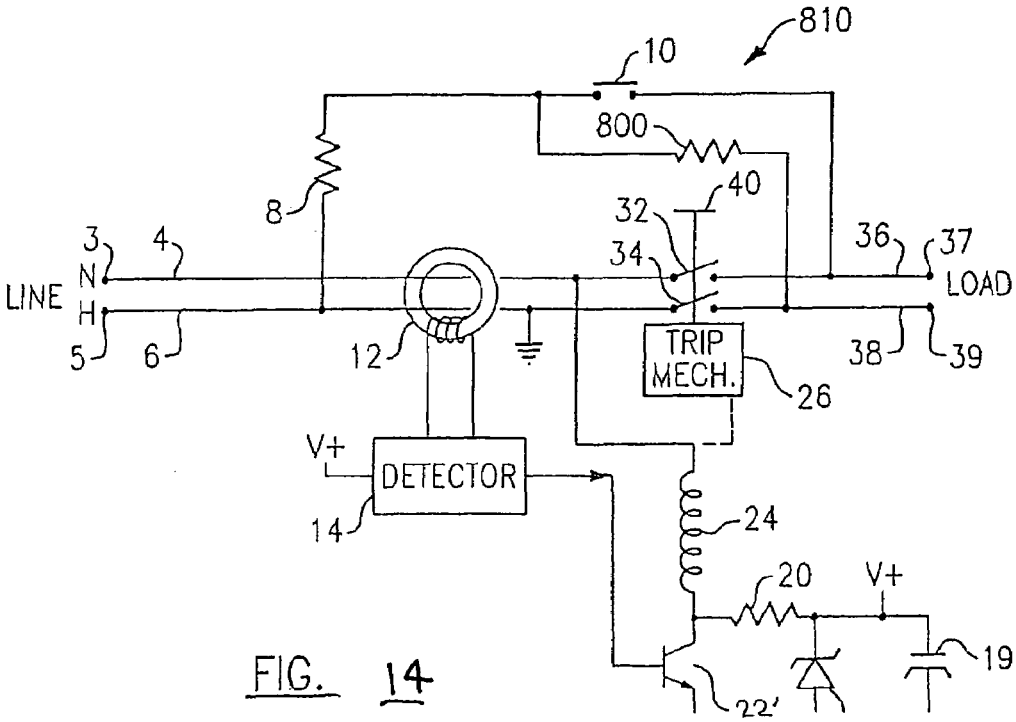
FIG. 14 is a schematic circuit diagram of an exemplary protective device according to another aspect of the invention.

Referring to FIG. 14, a protective device 810 that is an alternate embodiment to FIG. 13, shows a resistor 800 that serves the same function as resistor 700 in FIG. 13 but is coupled to the load side of the interrupting contacts, i.e., contact armatures 32, 34. This may be important for 6 mA GFCI receptacles and portables where the hot and neutral supply conductors are inadvertently transposed by the installer, wherein the hot side of the supply voltage from the electrical distribution system is connected to line terminal 5. If the armatures 32 and 34 in FIG. 13 are disconnected in response to a fault current, a hazardous current may yet flow through resistors 8 and 700 through ground fault 702 when contact 10 is depressed. However, if armatures 32 and 34 in FIG. 14 are disconnected, current flows through resistor 8 but not through resistor 800, which is not a problem because the current flow through resistor 8 alone has already been determined to be non-hazardous.

Figure 15:
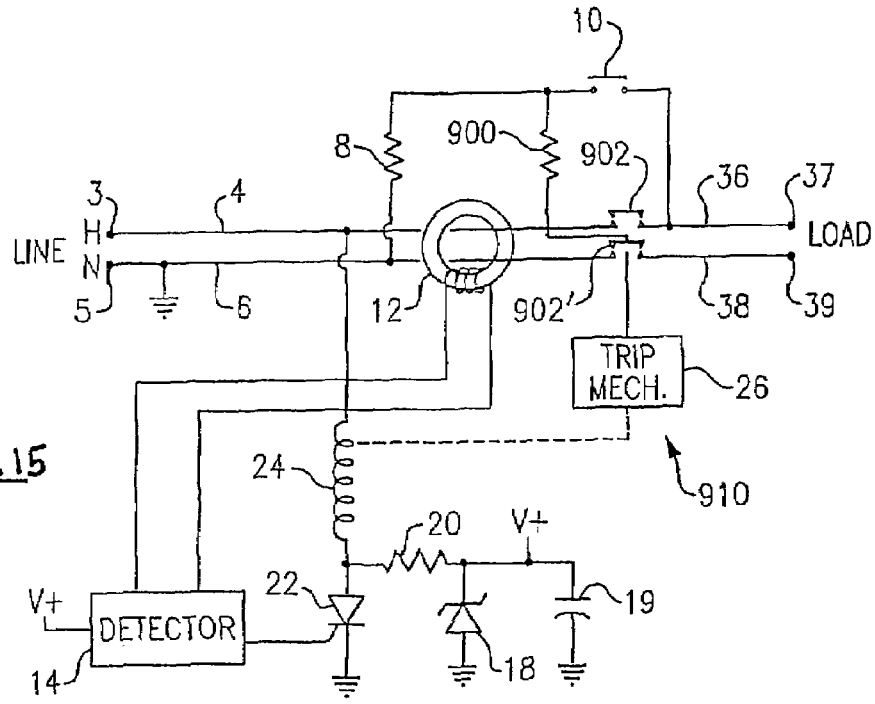
FIG. 15 is a schematic circuit diagram of an exemplary protective device according to another aspect of the invention.

Referring to FIG. 15, a protective device 910, which is an alternative embodiment to FIG. 14, is shown in which the trip mechanism comprises one or more bus bars. Reference is made to U.S. Pat. No. 5,510,760, which is incorporated herein by reference as though fully set forth in its entirety, for a more detailed explanation of the bus bar arrangement. Resistor 900 serves the same function as resistor 800 in FIG. 14 except that resistor 900 is coupled to moveable bus bar 902'. For receptacle housings it is possible for the installer to miswire a GFCI such that the supply voltage is connected to load terminals 37 and 39, which would cause resistor 800 (FIG. 14) to melt solder when contact 10 is depressed, even when device 810 is in good working condition, i.e., operational. The problem is alleviated in the embodiment of FIG. 15 whereby resistor 900 melts solder only when bus bar 902' remains connected when contact 10 is depressed, that is, when device 910 is non-operational. Miswiring thus does not cause a permanent lock-out of device 910.

Figure 16:
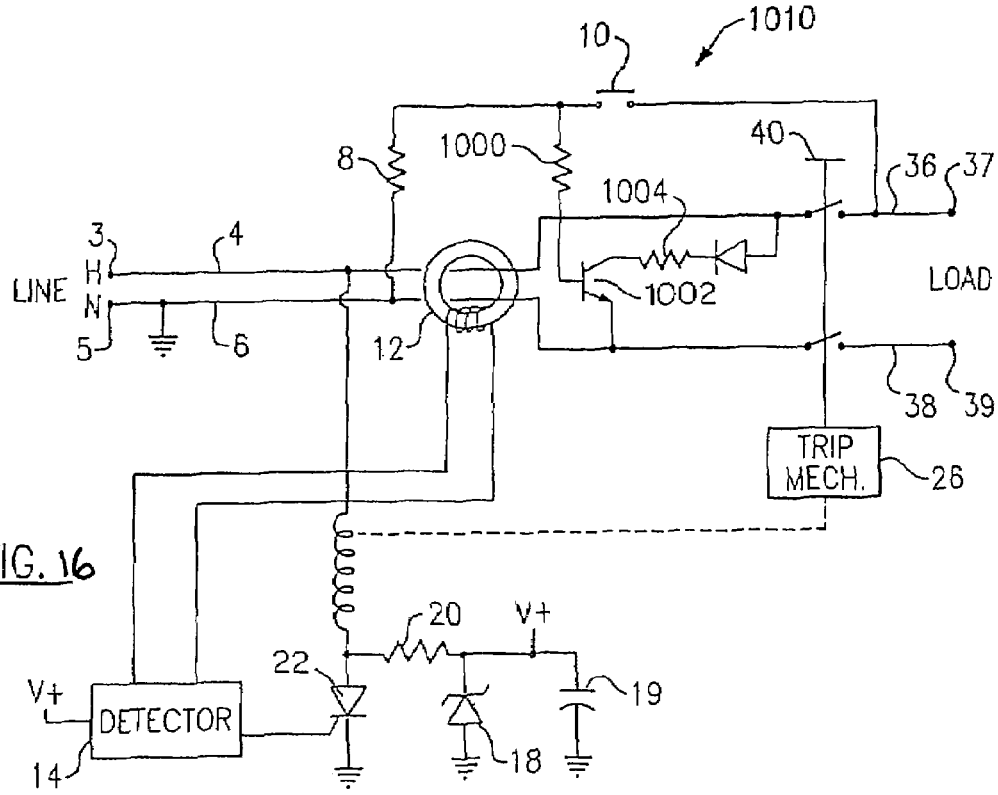
FIG. 16 is a schematic circuit diagram of an exemplary protective device according to another aspect of the invention.

Referring to FIG. 16, a protective device 1010 which is an alternate embodiment to FIG. 13 is shown, wherein contact 10 enables a current through resistor 8, as previously described, and a second current through a resistor 1000, in which the second current is preferably less than a tenth of the current through resistor 8. The second current depends on an interface circuit such as a transistor switch 1002. Transistor switch 1002 causes current to flow through a resistor 1004 of identical function to resistor 700 described in FIG. 13, i.e., resistor 1004 is normally in such a position as to leave spring 400 (FIG. 12) under tension, but when resistor 1004 heats up from the current through it sufficient to dislodge the solder affixing resistor 1004 to a fixed reference surface, the dislodgment of resistor 1004 releases spring 400.

FIG. 16 shows an alternative to FIG. 14 wherein a hazardous current does not occur when the hot and neutral supply conductors are inadvertently transposed as described in FIG. 14. In addition, FIG. 16 shows another remedy for the issue described in the FIG. 15 embodiment wherein resistor 1004 melts solder only if protective device 1010 is non-operational and not when protective device 1010 is miswired.

Figure 17:
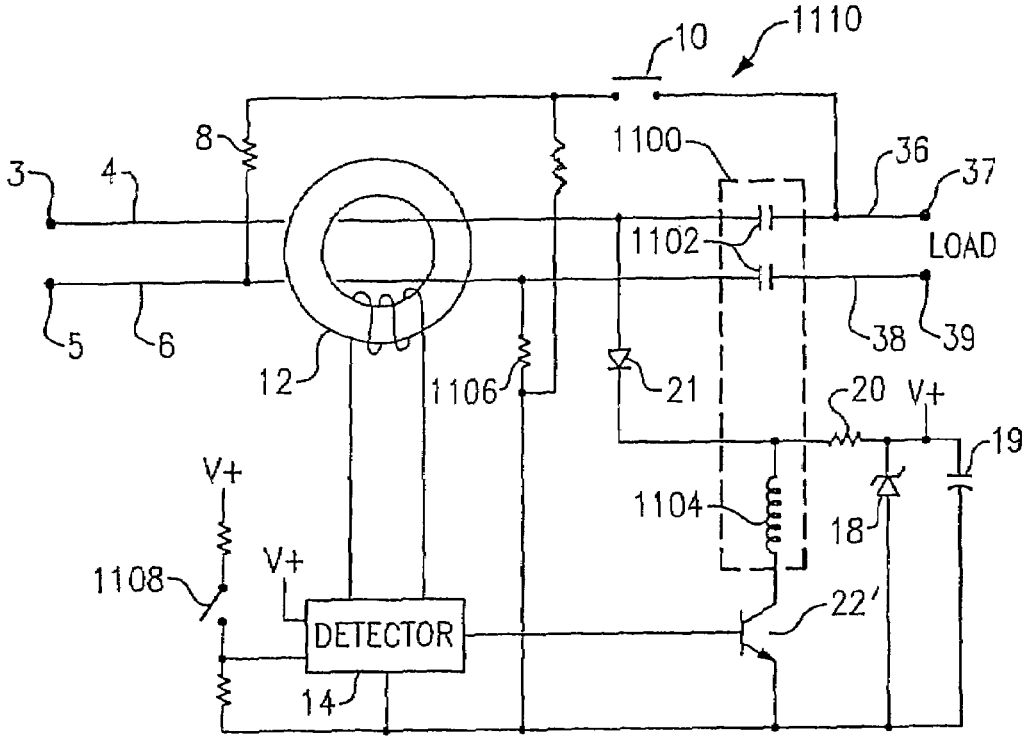
FIG. 17 is a schematic circuit diagram of an exemplary protective device according to another aspect of the invention.

Referring to FIG. 17, a protective device such as GFCI 1110 according to an alternate embodiment is shown, wherein the so called mouse trap mechanism, i.e., the tripping mechanism of the GFCI of FIGS. 9-13, is replaced by a relay 1100 having normally open contacts 1102 that connect or disconnect line terminals 3 and 5 from load terminals 37 and 39 respectively, and a solenoid 1104, which is designed to carry current when contacts 1102 of GFCI 1110 are connected, a construction that is common to, but not limited to, portable GFCI devices. Solenoid 1104 is designed to conduct current for the unlimited duration that GFCI 1110 is in use, wherein solenoid 1104 is not susceptible to burn-out caused by over-activation as previously described with respect to solenoid 24. A fusible element 1106 is in series with the solenoid and is designed to carry the continuous current through solenoid 1104 when transistor 22' is closed. Contact 10 enables current through resistor 8, which produces a difference current as previously described, and a common mode current, which, if the device is non-operational, enables a lock-out feature. The common mode current, which is greater than the solenoid current, is conducted through fusible element 1106.

If GFCI 1110 is operational, the load side is disconnected from the line side, causing the device to trip and resistor 8 and common mode currents to stop flowing even if contact 10 continues to be manually depressed. Fusible resistor 1106 must survive several thousand cycles of common mode current exposures from alternately depressing contact 10 to trip GFCI 1110 and switch 1108 to electronically reset GFCI 1110. The duration of each common mode current exposure is the expected time that GFCI 1110 requires for tripping after contact 10 has been depressed. If GFCI 1110 fails in some manner such that the trip time in response to depressing contact 10 is greater than the expected interval including the failure of GFCI 1110 to trip altogether, fusible element 1106 burns to an open circuit, permanently eliminating current through solenoid 1104 and rendering interrupting contacts 1102 in a permanently disconnected position. Fusible element 1106 can include a resistor.

Figure 18:
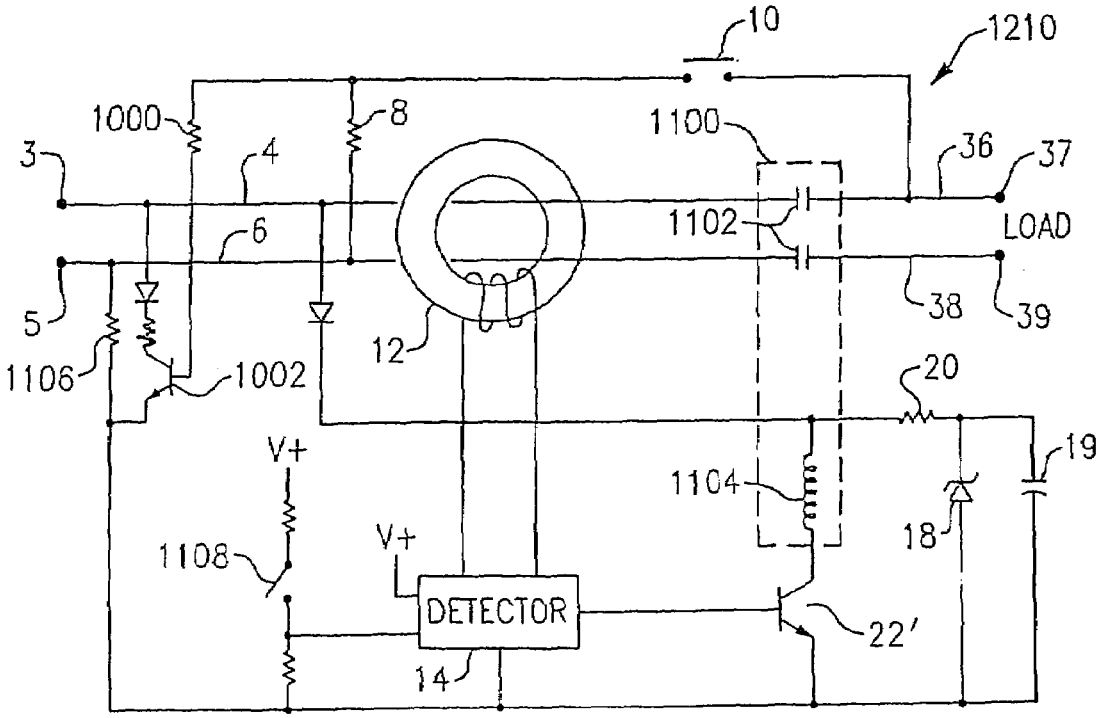
FIG. 18 is a schematic circuit diagram of an exemplary protective device according to another aspect of the invention.

Referring to FIG. 18, elements of the circuit diagram of FIG. 17 are combined with elements of the circuit diagram of FIG. 14 in a protective device 1210, wherein components having like functions bear like numbers. The concept shown in FIG. 17 is thus combined with the embodiment of FIG. 14 to protect against the inadvertent transposing of the hot and neutral supply conductors to terminals 3 and 5 from the electrical distribution system. For protective devices not equipped with a resistor 8, the value of resistor 1000 can be chosen so that current passing there through is less than 0.5 mA, which limit has been identified to be the perception level for humans.

Figure 19:
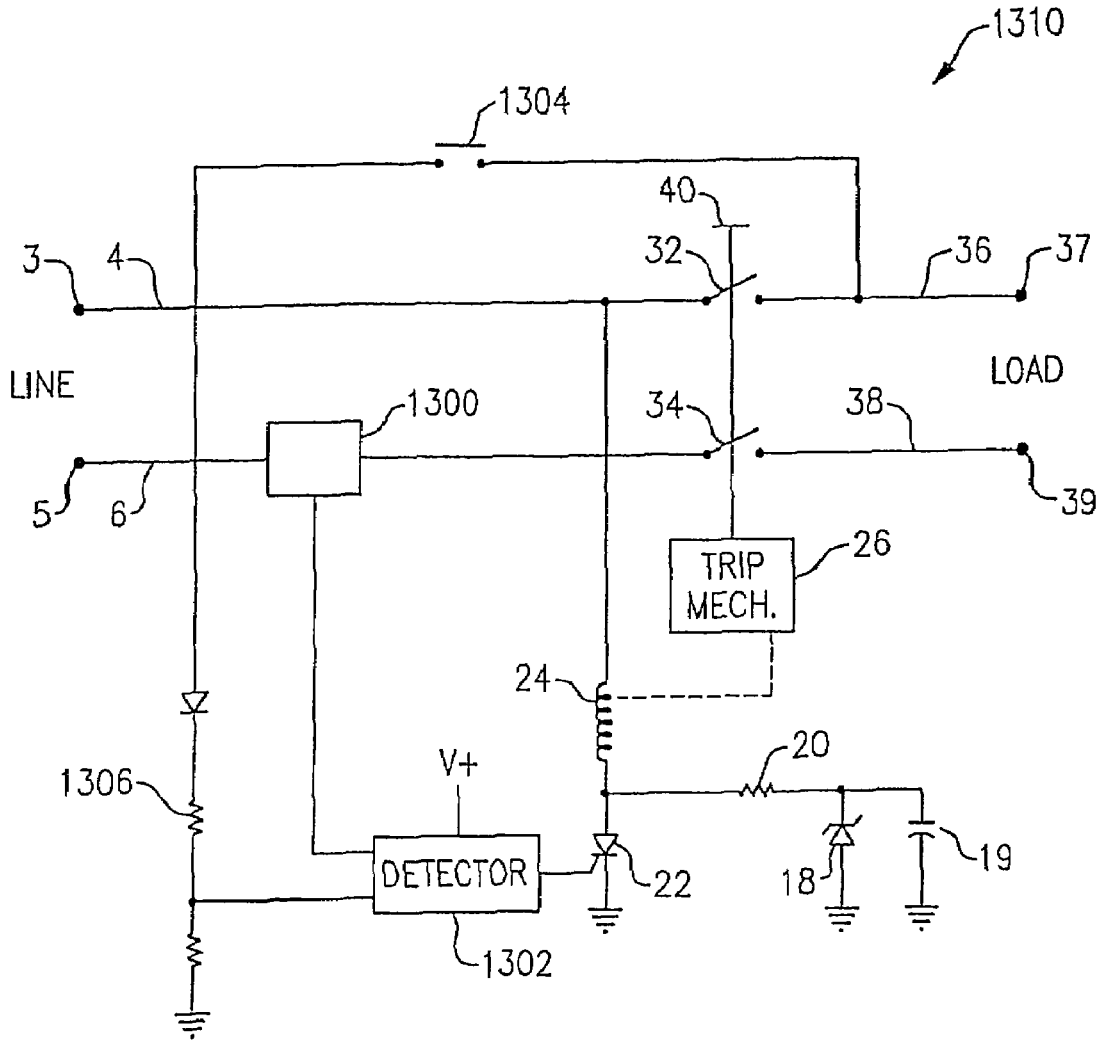
FIG. 19 is a schematic circuit diagram of an exemplary protective device according to an aspect of the invention.

Referring to FIG. 19, an alternate embodiment is shown in which the preceding concepts are applied to a general protective device 1310 representative of the class of general protective devices including AFCIs that require a contact 10 but that are not necessarily equipped with a GFCI or a sensor capable of sensing difference current. Reference is made to U.S. Pat. No. 6,421,214, which is incorporated herein by reference as though fully set forth in its entirety, for a more detailed explanation of protective device 1310. Components having like functions bear like numbers. Sensor 1300 is similar to sensor 12 but may be a current sensor or shunt for sensing load current through either conductor 6 or through conductor 4. A detector 1302 is similar to detector 14 (FIG. 7) but senses particular signatures in the load current as has been demonstrated in other patent applications as a method of identifying arc faults. A contact 1304 is similar to contact 10 (FIG. 7), which initiates a test of protective device 1310 when depressed. The test signal can be controlled by detector 1302 to test sensor 1300, detector 1302, switch 22, and trip mechanism 26. A resistor 1306 is similar to resistor 700 (FIG. 13), which is affixed to a fixed reference surface. If armatures 32 and 34 fail to operate due to a malfunction of protective device 1310, the longer duration of current through resistor 1306 causes sufficient self-heating of resistor 1306 to melt the solder affixing resistor 1306 to the fixed reference surface, wherein resistor 1306 is dislodged due to force exerted by lockout spring 400 (FIG. 10), wherein lockout spring 400 causes armatures 32 and 34 to be permanently disconnected.

Figure 20:
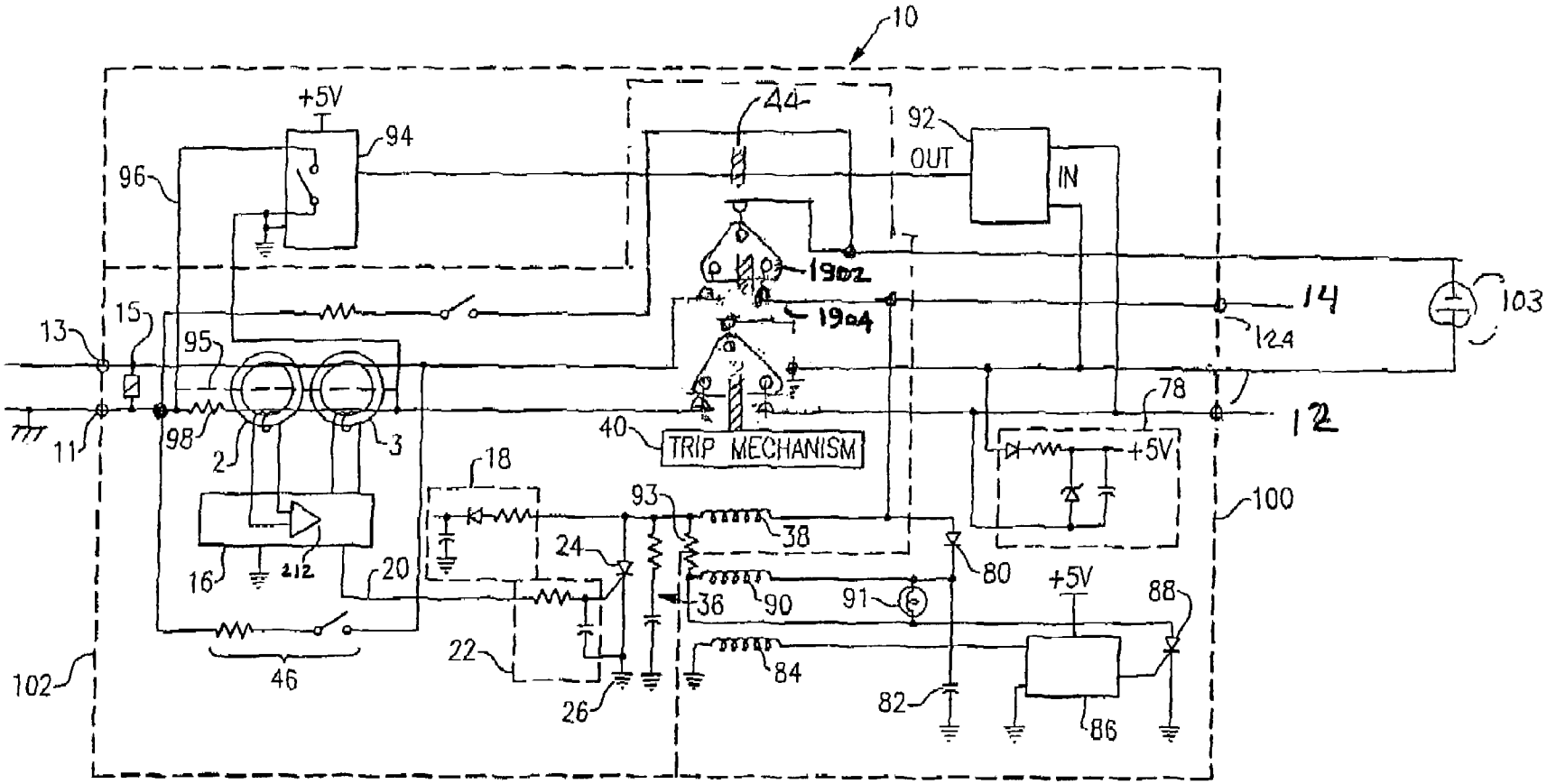
FIG. 20 is a block circuit diagram of an exemplary circuit protection device according to an aspect of the invention.

Another exemplary circuit protection component is shown in FIG. 20. The schematic diagram of FIG. 20 is a GFCI 10 configured to introduce a simulated ground fault every period during the negative half cycle that the trip SCR cannot conduct. If the device fails to detect the simulated ground fault, i.e., the self-test fails, the device is tripped on the next positive half cycle. As shown in FIG. 19, GFCI 10 protects an electrical circuit that provides electrical power to load 8. GFCI 10 is connected to the AC power source by way of line-side neutral terminal 11 and line-side hot terminal 13. GFCI 10 is coupled to load 8 by way of load side neutral terminal 12 and load-side hot terminal 14. GFCI 10 includes two main parts, Ground Fault Interrupt (GFI) circuit 102 and checking circuit 100. GFI circuit 102 includes a differential sensor 2 that is configured to sense a load-side ground fault when there is a difference in current between the hot and neutral conductors. Differential sensor 2 is connected to detector circuit 16, which processes the output of differential sensor 2. Detector 16 is connected to power supply circuit 18. Power supply 18 provides power for allowing detector 16 to detect a ground fault during both the positive half-cycle and the negative half cycle of the AC power. As such, detector circuit 16 provides an output signal on output line 20. The output line 20 is coupled to SCR 24 by way of filter circuit 22. When detector circuit 16 senses a fault, the voltage signal on output line 20 changes and SCR 24 is turned ON. SCR 24 is only able to turn ON during the positive half cycles of the AC power signal. Further, snubber network 36 prevents SCR 24 from turning on due to spurious transient noise in the electrical circuit. When SCR 24 is turned ON, solenoid 38 is activated. Solenoid 38, in turn, causes the trip mechanism 40 to release the interrupter contacts 42. When interrupter contacts 42 are released, the load-side of GFCI 10 is decoupled from the line-side power source of the electrical circuit. GFI circuit 102 also includes a grounded neutral transmitter 3 that is configured to detect grounded neutral conditions. Those skilled in the art understand that the conductor connected to neutral line terminal is deliberately grounded in the electrical circuit. On the other hand, a grounded neutral condition occurs when a conductor connected to load neutral terminal 12 is accidentally grounded. The grounded neutral condition creates a parallel conductive path with the return path disposed between load terminal 12 and line terminal 11. When a grounded neutral condition is not present, grounded neutral transmitter 3 is configured to couple equal signals into the hot and neutral conductors. As noted above, differential sensor 2 senses a current differential. Thus, the equal signals provided by grounded neutral transmitter 3 are ignored. However, when a grounded neutral condition is present, the signal coupled onto the neutral conductor circulates as a current around the parallel conductive path and the return path, forming a conductive loop. Since the circulating current conducts through the neutral conductor but not the hot conductor, a differential current is generated. Differential sensor 2 detects the differential current between the hot and neutral conductors. As such, detector 16 produces a signal on output 20 in response to the grounded neutral condition.

Interrupter contacts 42 are coupled to trip mechanism 40. Interrupter contacts 42 are configured to selectively couple and decouple the load-side terminals (12, 14) from the corresponding line-side terminals (11, 13). In one embodiment, trip mechanism 40 is arranged in what is known in the art as a mouse trap arrangement. Interrupter contacts 42 include spring loaded contacts. When the trip mechanism 40 is activated, the spring-loaded contacts 42 are opened and latched in an open condition. Interrupter contacts 42 are manually reset (closed) by depressing reset button 44.

In another embodiment, trip mechanism 40 and circuit interrupter 42 may be configured as a relay in which the contacts are normally open. In this alternative construction, when the trip mechanism 40 is de-activated, the contacts are biased open until such time as trip mechanism 40 is re-activated. As noted previously, GFCI 10 is configured to detect both ground faults and grounded neutral conditions.

As noted initially, GFCI 10 includes a checking circuit 100. Checking circuit 100 causes GFI 102 to trip due to an internal fault also known as an end of life condition. Examples of an end of life condition include, but are not limited to, a non-functional sensor 2, grounded neutral transmitter 3, ground fault detector 16, filtering circuit 22, SCR 24, snubber 36, solenoid 38, or power supply 18. An internal fault may include a shorting or opening of an electrical component, or an opening or shorting of electrical traces configured to electrically interconnect the components, or other such fault conditions wherein GFI 102 does not trip when a grounded neutral fault occurs.

Figure 21:
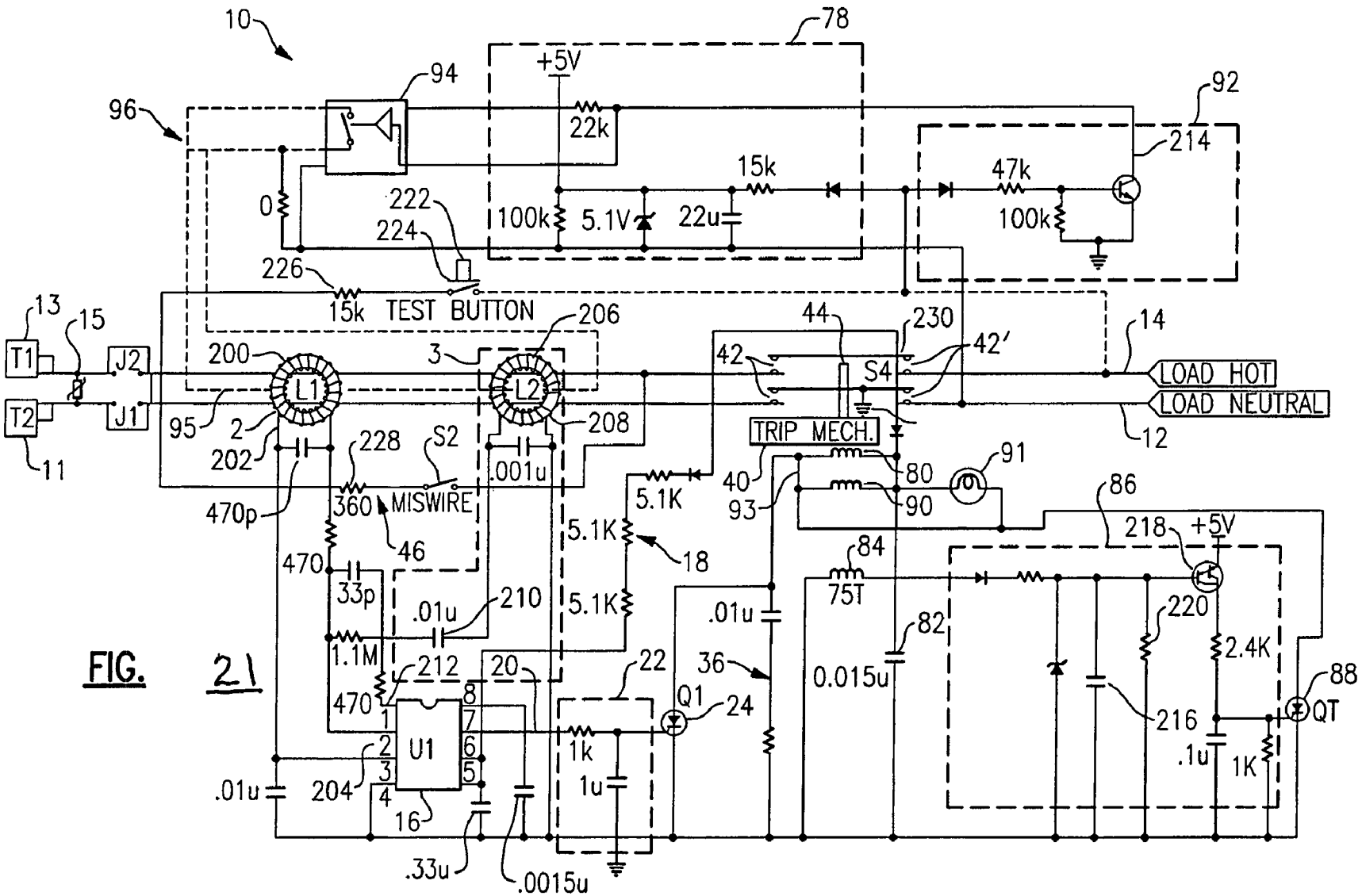
FIG. 21 is a block circuit schematic of an exemplary circuit protection device according to an aspect of the invention.

Referring to FIG. 21, checking circuit 100 includes several functional groups. The components of each group are in parenthesis. These functions include a fault simulation function (92, 94, 96), a power supply function 78, a test signal function (38,80,82,84), a failure detection function (86), and failure response function (88, 90,91).

Fault simulation is provided by polarity detector 92, switch 94, and test loop 96. Polarity detector 92 is configured to detect the polarity of the AC power signal, and provide an output signal that closes switch 94 during the negative half cycle portions of the AC power signal, when SCR 24 cannot turn on. Test loop 96 is coupled to grounded neutral transmitter 3 and ground fault detector 2 when switch 94 is closed. Loop 96 has less than 2 Ohms of resistance. Because polarity detector 92 is only closed during the negative half cycle, electrical loop 96 provides a simulated grounded neutral condition only during the negative half cycle. However, the simulated grounded neutral condition causes detector 16 to generate a fault detect output signal on line 20.

The test signal function provides an oscillating ringing signal that is generated when there is no internal fault condition. Capacitor 82 and solenoid 38 form a resonant circuit. Capacitor 82 is charged through a diode 80 connected to the AC power source of the electrical circuit. SCR 24 is on momentarily to discharge capacitor 82 in series with solenoid 38. Since the discharge event is during the negative half cycle, SCR 24 immediately turns off after capacitor 82 has been discharged. The magnitude of the discharge current and the duration of the discharge event are insufficient for actuating trip mechanism 40, and thus interrupting contacts 42 remain closed. When SCR 24 discharges capacitor 40 during the negative AC power cycle, a field is built up around solenoid 38 which, when collapsing, causes a recharge of capacitor 82 in the opposite direction, thereby producing a negative voltage across the capacitor when referenced to circuit common. The transfer of energy between the solenoid 38 and capacitor 82 produces a test acceptance signal as a ringing oscillation. Winding 84 is magnetically coupled to solenoid 38 and serves as an isolation transformer. The test acceptance signal is magnetically coupled to winding 84 and is provided to reset delay timer 86.

The failure detection function is provided by delay timer 86 and SCR 88. Delay timer 86 receives power from power supply 78. When no fault condition is present, delay timer 86 is reset by the test acceptance signal during each negative half cycle preventing timer 86 from timing out. If there is an internal fault in GFI 102, as previously described, the output signal on line 20 and associated test acceptance signal from winding 84 which normally recurs on each negative half cycle ceases, allowing delay timer 86 to time out.

SCR 88 is turned on in response to a time out condition. SCR 88 activates solenoid 90, which in turn operates the trip mechanism 40. Subsequently, interrupter contacts 42 are released and the load-side terminals (12, 14) are decoupled from the power source of the electrical circuit. If a user attempts to reset the interrupting contacts by manually depressing the reset button 44, the absence of test acceptance signal causes GFI 10 to trip out again. The internal fault condition can cause GFI 10 to trip, and can also be indicated visually or audibly using indicator 91. Alternatively, solenoid 90 can be omitted, such that the internal fault condition is indicated visually or audibly using indicator 91, but does not cause GFI 10 to trip. Thus the response mechanism in accordance with the present invention can be a circuit interruption by circuit interrupter 40, an indication by indicator 90, or both in combination with each other. Checking circuit 100 is also susceptible to end of life failure conditions. Checking circuit 100 is configured such that those conditions either result in tripping of GFI 102, including each time reset button 44 is depressed, or at least such that the failure does not interfere with the continuing ability of GFI 102 to sense, detect, and interrupt a true ground fault or grounded neutral condition. For example, if SCR 88 develops a short circuit, solenoid 90 is activated each time GFI 102 is reset and GFI 102 immediately trips out. If one or more of capacitor 82, solenoid 90 or winding 84 malfunction, an acceptable test signal will not be generated, and checking circuit 100 will cause GFI 102 to trip out. If polarity detector 92 or switch 94 are shorted out, the grounded neutral simulation signal is enabled during both polarities of the AC power source. This will cause GFI 102 to trip out. If polarity detector 92 or switch 94 open circuit, there is absence of grounded neutral simulation signal, and delay timer 86 will not be reset and GFI 102 will trip out. Solenoids 38 and 90 are configured to operate trip mechanism 40 even if one or the other has failed due to an end of life condition. Therefore if solenoid 90 shorts out, trip mechanism 40 is still actuable by solenoid 38 during a true fault condition. If power supply 78 shorts out, power supply 18 still remains operational, such that GFI 102 remains operative.

Although much less likely to occur, some double fault conditions cause GFI 102 to immediately trip out. By way of illustration, if SCR 88 and SCR 24 simultaneously short out, solenoids 38 and 90.

In FIG. 21, ground fault detector 16 is an R V 4141 integrated circuit manufactured by Fairchild Semiconductor. Ground fault detector 2 is implemented as a toroidally shaped magnetic core 200 about which a winding 202 is wound. Winding 202, typically having 1,000 turns, is coupled to an input terminal 204 of ground fault detector 16. Grounded neutral transmitter 3 is implemented as a second toroidally shaped magnetic core 206 about which a winding 208 is wound. Winding 208, typically having 200 turns, is coupled in series with a capacitor 210 to the gain output terminal 212 of ground fault detector 16. Hot and neutral conductors 13 and 11, and wire segment 95 if used, pass through the apertures of cores 200 and 206. During either a true grounded neutral condition, or during a simulated grounded neutral condition, low level electrical noise indigenous to the electrical circuit or to ground fault detector 16 creates a magnetic flux in either core 200 or 206, or both, flux in core 206 having been induced by winding 208. Core 206 induces a circulating current in electrical loop 96, which induces a flux in core 200. The resulting signal from winding 202 is amplified by the gain of ground fault detector 16 to produce an even greater flux in core 206 via winding 208. Through the regenerative feedback action as has been described, ground fault detector 16 breaks into oscillation, typically 5 to 10 kHz. The oscillation produces a signal on output 20 during a grounded neutral fault or simulated grounded condition as has been previously described.

As shown in FIG. 20, switch 94 may be implemented as an analog switch, such as USW 1 MAX 4626, manufactured by Maxim Semiconductor. Polarity detector 92 may be implemented using transistor 214, which closes switch 94 during the negative half cycle portions of the AC power supply of the electrical distribution system. Delay timer 86 includes a capacitor 216, which is configured to hold a pre-established voltage when test acceptance signals are properly received. The pre-established voltage prevents transistor 218 from turning SCR 88 ON. An end of life condition is signaled by the cessation of the test acceptance signal. In the absence of the test acceptance signal, the voltage on capacitor 216 decays below the pre-established voltage within a pre-established time interval, the rate of decay being established by bleeder 220. In response, transistor 218 actuates SCR 88 and GFI 102 is tripped. The pre-established time interval is chosen such that checking circuit 100 is not responsive to normal transient conditions that may exist in the electrical circuit, such as momentary or intermittent loss of AC power supply voltage or momentary voltage transients, but responsive solely to end of life conditions.

GFCI 10 may be equipped with a manually accessible test button 222 for closing switch contacts 224 for initiating a simulated grounded hot fault signal, or alternatively, a simulated grounded neutral fault signal. If GFI 10 is operational, closure of switch contacts 224 initiates a tripping action. The purpose of the test button feature may be to allow the user to control GFCI 10 as a switch for applying or removing power from load 8, in which case test button 22 and reset button 44 have been labeled "off" and "on" respectively. Usage of test button 222 does not affect the performance of checking circuit 100, or vice-versa.

GFCI 10 may also be equipped with a miswiring detection feature such as miswire network 46. Reference is made to U.S. Pat. No. 6,522,510, which is incorporated herein by reference as though fully set forth in its entirety, for a more detailed explanation of miswire network 46. Briefly stated, miswire network 46 is configured to produce a simulated ground fault condition. During the installation of GFCI 10 if the power source voltage is coupled to the line terminals 11 and 13 as intended, the current through network 46 causes GFI 102 to trip but the current through network 46 continues to flow, until such time as network 46 open circuits due to heating of a fusible component included in network 46. The fusible component may be implemented by resistor 228, configured to fuse in typically 1 to 10 seconds. When the fusible component opens, the GFCI is able to be reset. Subsequently, GFI 102 and checking circuit 100 operate in the previously described manner. However, if the power source is connected to the load terminals, i.e., if GFCI 10 is miswired during installation, GFI 102 trips as before, but interrupting contacts 42 immediately terminate the current flow through network 46, typically in less than 0.1 seconds. This time period is too brief an interval to cause the fusible component to fail. Thus, when GFCI 10 is miswired the fusible element in network 46 remains intact, and reset button 44 cannot effect a resetting action. GFCI 10 cannot be reset regardless of signals to or horn checking circuit 100.

GFCI 10 is properly wired and tested during an installation, miswire network 46 will fuse open and not be available to afford miswire protection if GFCI 10 happens to be re-installed. However, the checking circuit 100 can be configured to extend miswire protection to the re-installation. During the course of re-installation, the user depresses test button 222 to close contacts 224. If GFCI 10 has been miswired, power supply 78 is connected to the load side of interrupting contacts 42 and delay timer 86 receives power. Power supply 18 is connected to a bus bar 230 between interrupting contacts 42 and 42'. Since interrupting contacts 42' are open, ground fault detector 16 does not receive power, and test acceptance signal is not communicated by winding 84 to charge capacitor 216 to a voltage greater than the pre-determined threshold. As a result, transistor 218 turns SCR 88 ON, and solenoid 90 activates trip mechanism 40. Whenever the reset button is depressed, the trip mechanism is activated such that the interrupter contacts do not remain closed. Thus the checking circuit 100 interprets are-installation miswiring as it would an end-of-life condition. Thereafter, GFCI 10 can only be reset when it is re-installed and wired properly.

Miswiring circuits generally serve to deny the coupling of power from the feed-through terminals to the line terminals when the protective device is miswired. The user is expected to recognize that power has been denied and to subsequently remediate the miswired condition. However, such power denial does not assure that the miswired condition will be remediated. For example, a load is not necessarily connected to the line terminals in which case power denial to the line terminals goes totally undetected. As has been depicted, the respective plug receptacle terminals and feed-through terminals are permanently connected together at load terminals 12, 14, (37, 39). Thus if a miswired condition is ignored or goes undetected, a fault condition in a load connected to the plug receptacle terminals would be permanently connected to the power source by way of the feed-through terminals.

The circuit interrupter in FIG. 20 is configured to break electrical connection between at least one pair of plug receptacle and feed-through terminals when GFCI 10 (or a protective device in general) has been miswired. Thus when GFCI 10 has been miswired, power does not flow to a load connected to the plug receptacle terminals. In particular, at least one contact 1902 is provided. Contact 1902 is configured to electrically connect with a contact 1904 when GFCI 10 is in the reset state. Contacts 1902 breaks electrical connection with contact 1904 when GFCI 10 is in the tripped state. Contact pair 1902/1904 is disposed between a respective feed-through terminal 124 and a plug receptacle terminal 103. Thus when GFCI 10 is miswired and thus cannot remain in a reset state, a user load attached to plug receptacle terminals 103 is disconnected from the source of power at the feed-through terminals 124. Contacts 1902, 1904 may each be disposed on a cantilever beam. Alternatively one contact

1902, 1904 may be disposed on a fixed member. Alternatively, one contact 1902, 1904 may be disposed on a bus bar structure.

Figure 22:
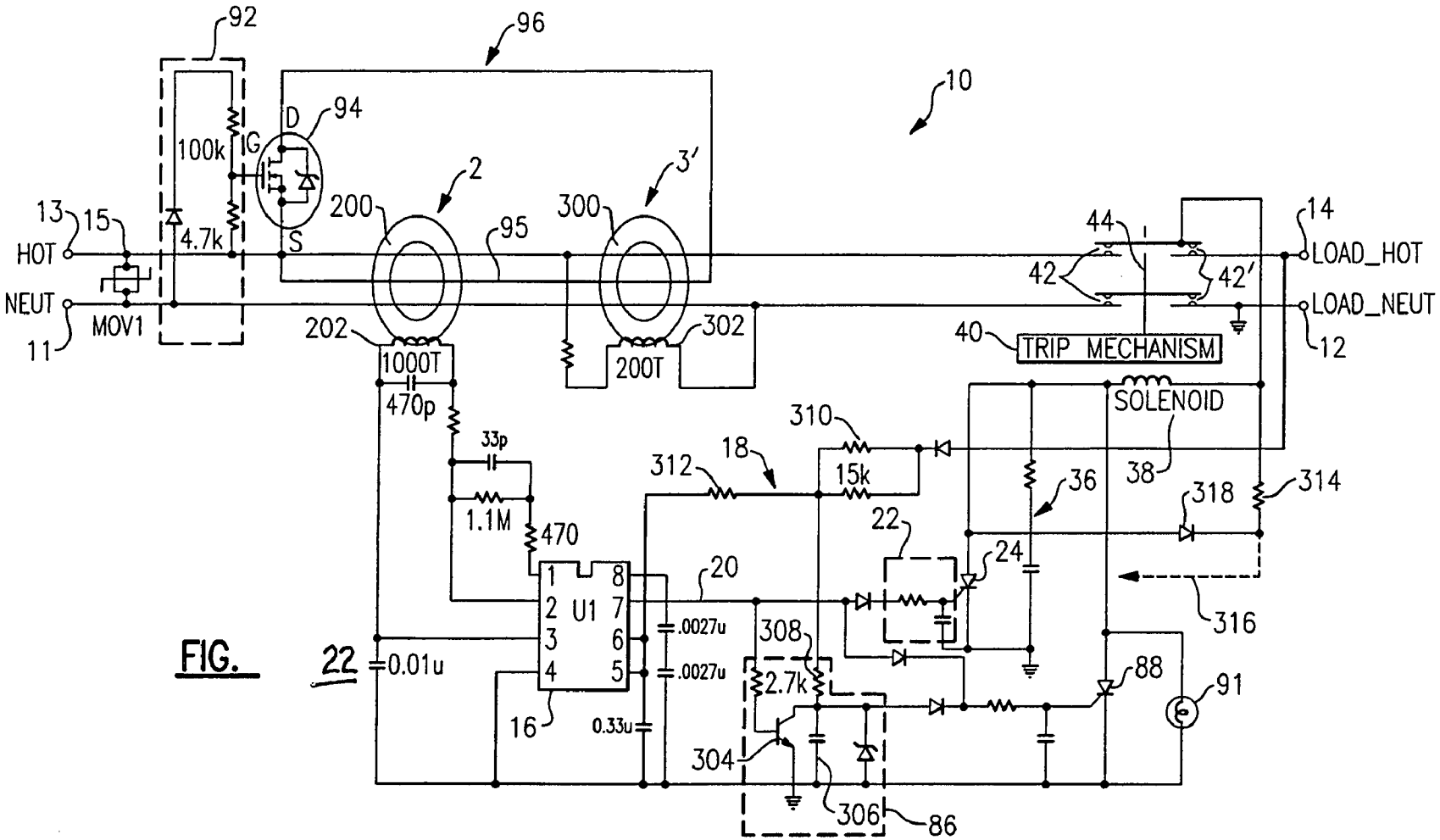
FIG. 22 is a circuit schematic of an exemplary circuit protection device according to an aspect of the invention.

In the exemplary circuit depicted in FIG. 22, both GFI 102 and checking circuit 100 derive power from power supply 18. Redundant components can be added such that if one component has reached end of life, another component maintains the operability of GFI 102, thereby enhancing reliability, or at least assuring the continuing operation of the checking circuit 100. For example, the series pass element 310 in power supply 18 can include parallel resistors. Resistor 312 can be included to prevent the supply voltage from collapsing in the event the ground fault detector 16 shorts out. Clearly, if the supply voltage collapses, delay timer 86 may be prevented from signaling an end of life condition. Those of ordinary skill in the art will recognize that there are a number of redundant components that can be included in GFCI 10, the present invention should not be construed as being limited to the foregoing example.

Alternatively, SCR 88 may be connected to an end of life resistor 314 as shown by dotted line 316, instead of being connected to solenoid 38 or 90. When SCR 88 conducts, the value of resistor 314 is selected to generate an amount of heat in excess of the melting point of solder on its solder pads, or the melting point of a proximate adhesive. The value of resistor 314 is typically 1,000 Ohms. Resistor 314 functions as part of a thermally releasable mechanical barrier. When the solder pads are melted, resistor is dislodged causing the barrier to move, and trip mechanism 40 to operate. The actuation of the barrier causes interrupting contacts 42 and/or 42' to be permanently open. In other words, depressing reset button 44 will not close interrupting contacts 42,42'. Reference is made to U.S. Pat. No. 6,621,388, which is incorporated herein by reference as though fully set forth in its entirety, for a more detailed explanation of resistor 314. Since end of life resistor 314 affords a permanent decoupling of the load side of GFCI 10 from the AC power source, it is important that the end of life resistor 314 only dislodge when there is a true end of life condition and not due to other circumstances, such as transient electrical noise. For example, SCR 88 may experience self turn-on in response to a transient noise event. Coupling diode 318 may be included to decouple resistor 314 in the event of a false end of life condition. Coupling diode 318 causes SCR 88 to activate solenoid 38 when it is ON".

Referring to FIGS. 23*a*-23*g*, timing diagrams illustrating the operation of the circuits depicted in FIG. 21 and FIG. 22 are shown. FIGS. 23*a* through 23*e* pertain to the embodiment shown in FIG. 21. Referring to FIG. 23*a*, the AC power source signal is shown, having positive half cycles 400 and negative half cycles 402. Referring to ground fault detector 16 in FIG. 20, FIG. 23*b* represents the wavefront at gain output terminal 212. Voltage signal 404 is the quiescent level when there is no grounded neutral condition, whether a simulated fault condition or true fault condition. The quiescent voltage level 404 is centered between pre-established voltage thresholds 406 and 406'. The threshold levels are established by ground fault detector 16. During each negative half cycle 402, switch 94 is closed to initiate the simulated grounded neutral signal resulting in the on-set of oscillation signal 408. The amplitude of the oscillation 410 may decay in relationship to the instantaneous voltage of power supply 18.

FIG. 23*c* shows the output voltage signal 412 present on detector output line 20. The duration of each output signal 412 corresponds to the interval in which the voltage at gain output terminal 212 is either greater than threshold 406, or less than threshold 406'. Output signal 412 is detected by delay timer 86 as the above described test acceptance signal.

FIG. 23*d* represents a true grounded neutral condition that occurs in combination with the simulated grounded neutral condition. Those of ordinary skill in the art will recognize that the present invention functions equally well during a true ground fault or true arc fault condition. Referring back to FIG. 23*d*, an oscillation signal 416 is present during at least one positive half cycle 400 as a result of the fault condition.

FIG. 23*e* is a representation of the voltage signal 418 at the output of filter 22. There are two things that are of note. First, voltage signal 418 occurs during the positive half cycle 400. Second, once voltage 418 is greater than voltage threshold 414, SCR 24 is turned ON, and GFI 102 is tripped out.

Figure 23:
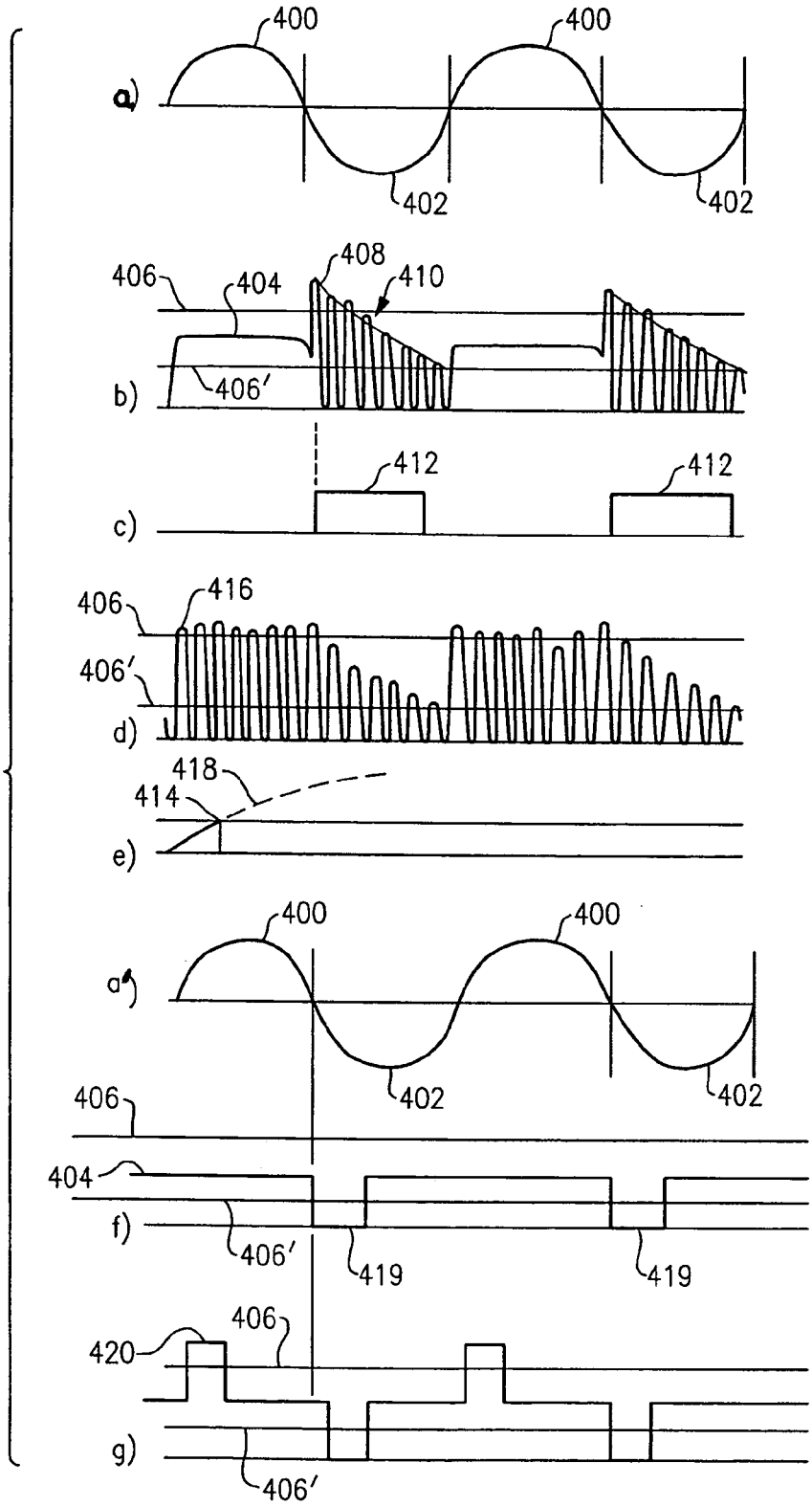
FIGS. 23*a-g* are timing diagrams illustrating the operation of the circuits depicted in FIG. 21 and FIG. 22.

FIGS. 23*a'*, 23*f* and 23*g* pertain to the embodiment of FIG. 22. As described above, the embodiment of FIG. 22 employs saturating neutral core 3'. FIG. 23*a'* is identical to FIG. 23*a* and repeated for the reader's convenience. FIG. 23*f* shows voltage signal 404 at the gain output terminal 12 during a simulated grounded neutral condition. Negative-tending impulses 419 corresponds to each negative half cycle of the AC power source 402. The impulses shown in FIGS. 23*f* and 23*g* compared to the oscillation signals shown in FIGS. 23*b* and 23*d* produce similar results. During a true grounded neutral condition, there is additionally at least one positive-tending impulse 420 during a positive half cycle 400 of the AC power source. The results shown in FIG. 23 are equally applicable to a true ground fault condition or a true arc fault condition.

Figure 24:
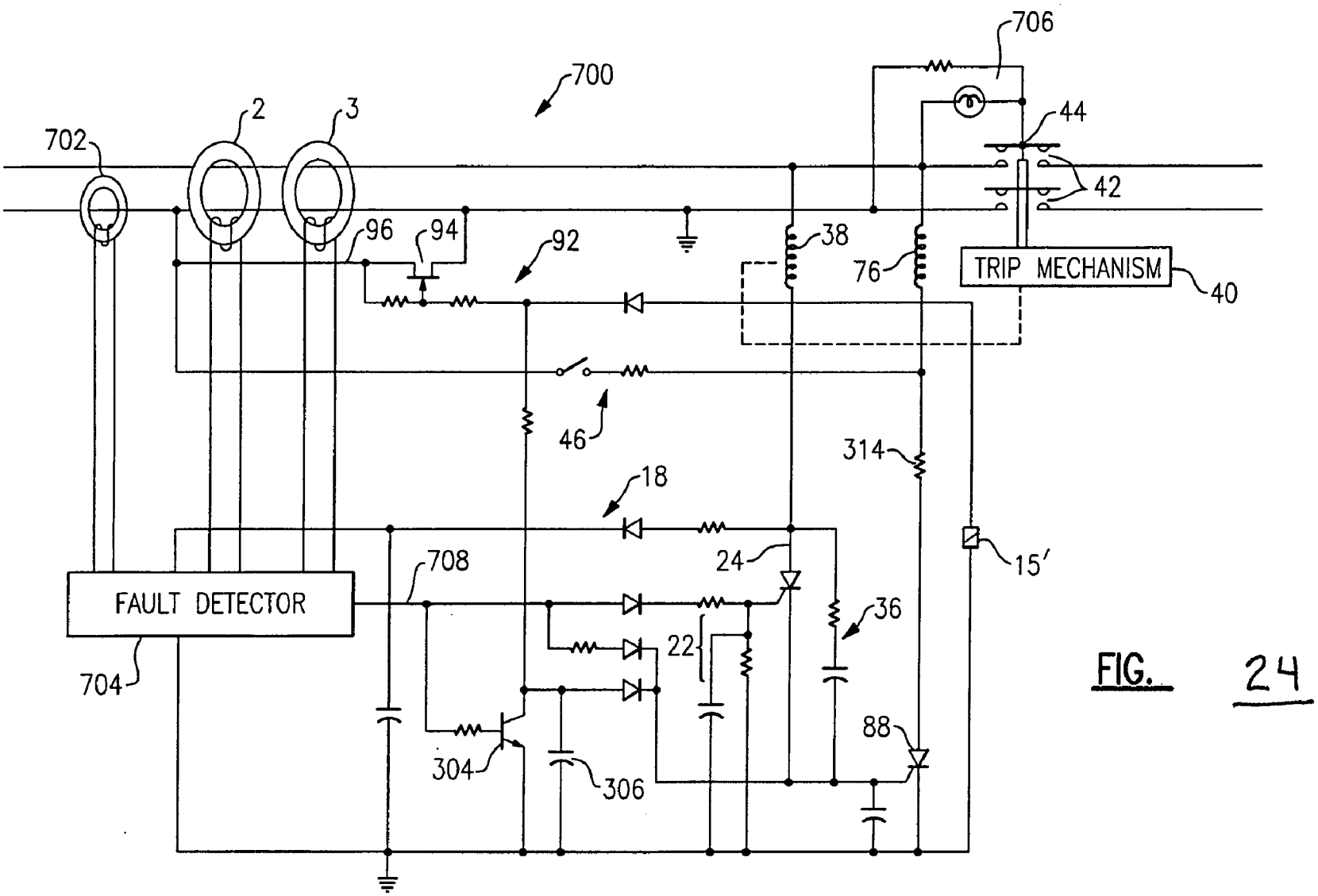
FIG. 24 is a schematic circuit diagram of another exemplary protective device according to an aspect of the invention.

Another exemplary circuit schematic is depicted in FIG. 24. Protective device 700 is configured to protect the electrical circuit from a plurality of fault conditions that include ground faults, grounded neutral faults, arc faults to ground, parallel arc faults between the line and neutral conductors, and series arc faults within a line or neutral conductor. Protective device 700 includes one or more additional sensors, such as sensor 702, to detect series arc faults and parallel line to neutral arc faults, since differential transformer 2 is configured to ignore all but differential currents. In one embodiment, sensor 702 is a current sensor configured to sense the current on the hot or neutral conductor. Fault detector 704 is similar to ground fault detector 16, but is also configured to detect and respond to other signals, such as arc recognition signatures. Output 708 operates in a manner similar to what has been described for output 20, but further provides trip signal for the above described fault conditions during the positive half cycle portions of the AC power source.

Other features illustrated in FIG. 24 include a trip indicator 706 that illuminates or annunciates when protective device 700 is tripped. The end of life lockout feature embodied in FIG. 24 allows solenoid 38 and power supply 18 to be connected to the line side of interrupting contacts 42 without sacrificing protection if solenoid 38 reaches end of life. In particular, solenoid 38 is configured to carry current only momentarily. A shorted or opened component may result in a continuous current being supplied. For example, this may occur when SCR 24 is shorted out. Since solenoid 38 is not coupled to the AC power source through interrupting contacts 42, the opening of the contacts fails to limit the duration of the current to prevent overheating of the solenoid. However, the current flowing through solenoid 38 also flows through SCR 24. As a result, SCR 88 is activated and power is applied to end of life resistor 314. As described above, the resistor will be heated to a temperature greater than the melting point of the solder, or proximate adhesive, and the resistor 314 will fail. Of course, this results in a lock-out condition wherein interrupting contacts 42 are permanently opened. Thus the end of life lockout feature is effective even if solenoid 38 is impaired through over activation.

In yet another feature, an auxiliary impedance 710, preferably including an inductance, couples power from the AC power source to polarity detector 92 and miswire network 46. The value of impedance 710 is chosen to be greater than 50 Ohms in the presence of high frequency impulse noise on the electrical circuit, such as caused by lightning activity. The impedance permits a small metal oxide varistor 15', rated less than one Joule, to protect polarity detector 92 and miswire network 46 from damage. Likewise, the inductance of solenoid 38 is chosen such that snubber network 36 protects SCR 24 and power supply 18 from damage. The use of an auxiliary impedance in combination with other impedances, such as the impedance of a solenoid, is an alternative design that avoids using an across-the-line metal oxide varistor such as MOV 15 in FIG. 20. An across-the-line varistor is typically greater than 12 mm in size. The excessive size is a result of a requirement that the varistor successfully absorb the full energy of the voltage impulse. As shown, auxiliary impedance 710 is a stand-alone component, but could have been shown as sharing one of the magnetic cores of the inductors that have been previously described.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

We claim:

1. An electrical device configured to be disposed in an electrical distribution system including a power source, the device comprising:

a housing;

a common member disposed in the housing having a plurality of fixed contacts and a common terminal configured to be user connectable to the power source;

a plurality of switches corresponding to the plurality of fixed contacts for controlling the flow of electrical power from the power source, wherein each of the switches includes a user accessible surface, a pivot assembly having a cradle and a load terminal configured to be user connectable to a load, a plurality of pivot members each disposed in a respective cradle and in operative connection with the user accessible surface, each of the pivot members having a contact in operative alignment with a respective fixed contact, such that the common terminal and the load terminal are electrically connected when at least one of the pivot members is in an electrically closed position and wherein the common terminal and the load terminal are electrically disconnected when the pivot member is in an electrically open position via action of the user accessible surface.

2. The device of claim 1, wherein the power source is a hot line or a hot load.

3. The device of claim 1, wherein the plurality of switches are single pole switches.

4. The device of claim 1, wherein each of the pivot members is operatively movable in a direction that is parallel to a major longitudinal axis of the device.

5. The device of claim 4, wherein each of the pivot members has an axis of rotation that is perpendicular to a major longitudinal axis of the device.

6. The device of claim 5, comprising two, independent switches, wherein the two switches are adjacently disposed in the housing.

7. The device of claim 6, wherein the axis of rotation of each pivot member is a common axis of rotation for the two switches.

8. The device of claim 1, further comprising a circuit interrupter that is configured to connect or disconnect the power source from the load terminal, and a trip mechanism in operable communication with the circuit interrupter to disconnect the power source from the load terminal upon detection of a predetermined condition.

9. The device of claim 8, where in the at least one predetermined condition is a test cycle.

10. The device of claim 8, wherein the at least one predetermined condition is an electrical arc.

11. The device of claim 8, wherein the at least one predetermined condition is a ground fault.

12. The device of claim 8, wherein the at least one predetermined condition is a grounded neutral.

13. The device of claim 1, wherein the load terminal includes a feed-through terminal.

14. The device of claim 8, wherein the load terminal includes a plug receptacle terminal.

15. The device of claim 8, comprising two switches, wherein the two switches are adjacently disposed in the housing.

16. The device of claim 14, wherein the load terminal includes a feed-through terminal.

17. The device of claim 16, further including a first contact coupled to the feed-through terminal and a second contact coupled to the plug receptacle terminal, wherein the device is configured to break electrical connectivity between the first and second contacts when the device has been miswired.

18. The device of claim 17, wherein the first and second contacts are coupled to the circuit interrupter such the circuit interrupter breaks electrical connectivity between the first and second contacts when the circuit interrupter is in a tripped condition.

19. The device of claim 18, further including a miswire circuit, wherein the miswire circuit prevents the circuit interrupter from being reset when the device has been miswired.

20. The device of claim 8, further including a trip indicator mounted in the housing for indicating the status of the circuit protection portion.

21. The device of claim 8, wherein the circuit protection device includes an end of life circuit configured to disconnect the load terminals from the line terminals if the circuit protection device has reached an end of life condition.

22. The device of claim 8, wherein the circuit protection device includes an end of life circuit that includes an indicator configured to indicate if the protection device has reached an end of life condition.

23. An electrical device configured to be disposed in an electrical distribution system including a power source, the device comprising:

a common member disposed in a housing having a plurality of fixed contacts and a common terminal configured to be user connectable to the power source;

a plurality of switches corresponding to the plurality of fixed contacts for controlling the flow of electrical power from the power source;

a circuit interrupter that is configured to connect or disconnect the power source from the load terminal; and a trip mechanism in operable communication with the circuit interrupter to disconnect the power source from the load terminal upon detection of a predetermined condition wherein each of the switches includes a user accessible surface, a pivot assembly having a cradle and a load terminal configured to be user connectable to a load, a plurality of pivot members each disposed in a respective cradle and in operative connection with the user accessible surface, each of the pivot members having a contact in operative alignment with a respective fixed contact, such that the common terminal and the load terminal are electrically connected when at least one of the pivot members is in an electrically closed position and wherein the common terminal and the load terminal are electrically disconnected when the pivot member is in an electrically open position via action of the user accessible surface.

24. The device of claim 23, wherein the power source is one of a hot line and a hot load.

25. The device of claim 23, wherein the plurality of switches are single pole switches.

26. The device of claim 23, wherein each of the pivot members is operatively movable in a direction that is parallel to a major longitudinal axis of the device.

27. The device of claim 23, wherein each of the pivot members has an axis of rotation that is perpendicular to a major longitudinal axis of the device.

28. The device of claim 26, comprising two, independent switches, wherein the two switches are adjacently disposed in the housing.

29. The device of claim 28, wherein the axis of rotation of each pivot member is a common axis of rotation for the two switches.

30. The device of claim 23, wherein the at least one predetermined condition is a test cycle.

31. The device of claim 23, wherein the at least one predetermined condition is an electrical arc.

32. The device of claim 23, wherein the at least one predetermined condition is a ground fault.

33. The device of claim 23, wherein the at least one predetermined condition is a grounded neutral.

34. The device of claim 23, wherein the load terminal includes a feed-through terminal.

35. The device of claim 23, wherein the load terminal includes a plug receptacle terminal.

36. The device of claim 34, further including a first contact coupled to the feed-through terminal and a second contact coupled to the plug receptacle terminal, wherein the device is configured to break electrical connectivity between the first and second contacts when the device has been miswired.

37. The device of claim 36, wherein the first and second contacts are coupled to the circuit interrupter such the circuit interrupter breaks electrical connectivity between the first and second contacts when the circuit interrupter is in a tripped condition.

38. The device of claim 37, further including a miswire circuit, wherein the miswire circuit prevents the circuit interrupter from being reset when the device has been miswired.

* * * * *